US012703982B2

(12) United States Patent
Twin et al.

(10) Patent No.: US 12,703,982 B2
(45) Date of Patent: Aug. 11, 2026

(54) FASTENING SYSTEM

(71) Applicant: James Hardie Technology Limited, Dublin (IE)

(72) Inventors: Stephen John Twin, London (GB); Toby John Hammond, London (GB)

(73) Assignee: James Hardie Technology Limited, Dublin (IE)

( * ) Notice: Subject to any disclaimer, the term of this patent is extended or adjusted under 35 U.S.C. 154(b) by 267 days.

(21) Appl. No.: 18/404,716

(22) Filed: Jan. 4, 2024

(65) Prior Publication Data

US 2024/0240466 A1 Jul. 18, 2024

(30) Foreign Application Priority Data

Jan. 13, 2023 (EP) ..... 23151501

(51) Int. Cl.
*E04F 13/08* (2006.01)

(52) U.S. Cl.
CPC ..... *E04F 13/0805* (2013.01)

(58) Field of Classification Search
CPC ..... E04F 13/0805; E04F 13/0816; E04F 13/0819; E04F 13/0812; E04F 13/21; E04F 13/24; E04F 13/0801; E04B 9/06; E04B 9/22; E04B 9/242; E04B 2002/0202; E04B 1/7629
USPC ..... 52/384, 511, 506.05
See application file for complete search history.

(56) References Cited

U.S. PATENT DOCUMENTS 3,144,733 A * 8/1964 Balinski ..... E04B 2/56 52/285.3
3,815,309 A 6/1974 Olsen
4,408,427 A * 10/1983 Zilch ..... E04F 13/0823 52/774
4,553,366 A * 11/1985 Guerin ..... E04F 13/0805 52/506.08

(Continued)

FOREIGN PATENT DOCUMENTS

DE 9000858 U1 4/1990
KR 200235678 Y1 10/2001

(Continued)

OTHER PUBLICATIONS

Extended Search Report dated Jul. 7, 2023 in European Application No. 23151501.6, in 10 pages.

*Primary Examiner* — Brian E Glessner
*Assistant Examiner* — Adam G Barlow
(74) *Attorney, Agent, or Firm* — Knobbe, Martens, Olson & Bear, LLP

(57) ABSTRACT

A concealed fastening system suitable for securing a cladding element to a substrate may include a receiver comprising a base section and side sections extending from the base section such that a central cavity is formed, each side section comprising a hook remote from the base section; and a rail comprising a base element and side arms extending from the base element. The rail may seat within the central cavity of the receiver such that the side arms of the rail abut the hook of the receiver. In use, either the receiver or the rail may attach to a substrate and the other of the receiver or rail connects to a cladding element. The system optionally further comprises a bracket to which an adaptor plate is attached. In use, the bracket and adaptor plate may be seated between the substrate and either of the receiver or rail.

20 Claims, 23 Drawing Sheets

(56) References Cited

U.S. PATENT DOCUMENTS

| | | | | |
|---|---|---|---|---|
| 5,590,502 | A * | 1/1997 | Wendt | E04B 2/7457 52/489.1 |
| 8,042,310 | B2 * | 10/2011 | Hikai | E04F 13/0862 403/381 |
| 8,882,065 | B2 * | 11/2014 | Henriott | A47B 96/067 248/220.21 |
| 9,834,941 | B1 * | 12/2017 | Bilge | E04F 13/12 |
| 2002/0056244 | A1 * | 5/2002 | Hertweck | E04B 9/0478 52/519 |
| 2014/0196399 | A1 * | 7/2014 | Egri, II | E04B 1/945 52/704 |
| 2014/0325928 | A1 * | 11/2014 | White | F25D 23/085 52/506.05 |
| 2015/0361651 | A1 * | 12/2015 | Petzold | E04B 1/7637 52/698 |
| 2016/0168863 | A1 * | 6/2016 | Kwan | E04F 13/0805 52/36.5 |
| 2017/0030086 | A1 * | 2/2017 | Rodriguez Lopez | E04F 13/0812 |
| 2017/0226747 | A1 * | 8/2017 | Fernandez Fernandez | E04F 13/0864 |
| 2024/0060310 | A1 * | 2/2024 | Brough | E04F 13/0807 |
| 2024/0328169 | A1 * | 10/2024 | Torrejón Puchol | E04F 13/12 |
| 2024/0360677 | A1 * | 10/2024 | Heft | E04F 13/0805 |
| 2025/0347121 | A1 * | 11/2025 | Pöltinger | E04F 13/0816 |

FOREIGN PATENT DOCUMENTS

| | | | |
|---|---|---|---|
| WO | WO 2001/038667 | 5/2001 | |
| WO | WO-0138667 A1 * | 5/2001 | E04F 13/0826 |
| WO | WO 2017/042521 | 3/2017 | |

* cited by examiner

FASTENING SYSTEM

RELATED APPLICATIONS

This application claims the benefit of European Application No. 23151501.6, filed on Jan. 13, 2023, and entitled "A Fastening System," the entire contents of which are incorporated by reference herein and made part of this specification.

FIELD

The present disclosure generally relates to a fastening system suitable for use with cladding elements to form a building façade wherein the cladding elements are secured to a building surface or framework using the fastening system to form the building façade. In particular, the present disclosure relates to a concealed fastening system wherein the fastening system used to secure cladding elements to a building surface or framework is hidden from general view.

The embodiments have been developed primarily for use as a concealed fastening system for fiber cement cladding elements and will be described hereinafter with reference to this application. However, it will be appreciated that the concealed fastening system is not limited to this particular field of use and that the embodiments can also be used with other building products including other types of cladding elements and/or other fiber cement building products. Additionally, the embodiments of the concealed fastening system described hereinafter are with respect to a cladding system installed as an exterior building façade. It should be readily understood that the concealed fastening system of the present disclosure is also not limited to this particular application and that the embodiments hereinafter disclosed can also be used in an interior application if so desired.

BACKGROUND

Any discussion of the prior art throughout the specification should in no way be considered as an admission that such prior art is widely known of forms part of the common general knowledge in the field.

Cladding systems are widely known in building construction. In systems where façade panels or cladding elements of various types of materials are fixed to a substrate it is often desired to use a concealed or hidden fastening system to secure the façade panels to avoid face fixing the façade panel to the substrate through the exterior face of the façade panel. Such concealed fastening systems usually comprise a horizontal and vertical supporting framework to which the façade panels are secured using a complicated clip system. Such systems are expensive and complex to install. Such systems also provide limited flexibility to allow for on-site adjustments if required during installation.

SUMMARY

The present disclosure relates generally to a fastening system for use with cladding elements and is suitable for securing a cladding element to a substrate.

The embodiments have been developed primarily for use with fiber cement cladding panels, elements or articles and will be described hereinafter with reference to this application. However, it will be appreciated that the embodiments are not limited to this field of use and that the embodiments can be used to provide concealed fastening of any product in any suitable field of use known to the person skilled in the art.

According to the present disclosure there is provided a concealed fastening system as set out in appended claims 1 to 15.

In one embodiment, the concealed fastening system comprises a receiver comprising a base section and side sections extending from the base section such that a central cavity is formed, each side section comprising a first projection and a second projection wherein the first projection extends at an angle $\alpha$ from base section and the second projection extends at an angle $\beta$ from the first projection remote from the base section and wherein the second projection remote from the first projection comprises a hook, wherein the base section of the receiver is configured to mount to either a cladding element or a substrate; a rail comprising a base element and side arms extending from the base element, each side arm comprising a first flange extending orthogonally from base element, a second flange extending orthogonally from the first flange remote from the base element, a third flange extending orthogonally from the second flange remote from the first flange and a fourth flange extending at an angle $\delta$ from third flange remote from the second flange such that the fourth flanges of each side arm extend towards each other, wherein the rail seats within the central cavity of the receiver such that the second flange of the rail abuts the hook of the receiver, wherein the base element of the rail is configured to mount to either a cladding element or a substrate; and wherein angle $\delta$ of the rail is equal to or greater than angle $\beta$ of the receiver.

In one embodiment, angle $\delta$ is between approximately 94° and 158°+/−2°. In a further embodiment, angle $\delta$ is approximately 132°+/−2°.

In one embodiment, angle $\alpha$ is between approximately 92° and 156°+/−2°. In a further embodiment, angle $\alpha$ is approximately 125°+/−2°.

In one embodiment, $\beta$ is between approximately 93° and 157°+/−2°. In a further embodiment, angle $\beta$ is approximately 131°+/−2°.

In a further embodiment, when angle $\delta$ is approximately 132°+/−2°, angle $\alpha$ is approximately 125°+/−2, and angle $\beta$ is approximately 131°+/−2°.

In one embodiment, the second flange of the rail further comprises a nub at the junction between the second flange and the third flange. In a further embodiment, the second flange of the rail further comprises a groove at the junction between the second flange and the third flange.

In one embodiment, the side sections of the receiver further comprise extended side sections wherein extended side sections are positioned between the base section and the first projection of the receiver.

In one embodiment, the second projection and hook of the receiver further comprise a central cut-away portion.

In one embodiment, the concealed fastening system further comprises a bracket comprising a first plate and a second plate wherein the second plate extends orthogonally from the first plate and the second plate is configured to attach to the substrate; and an adaptor plate comprising a main plate and a secondary plate wherein the secondary plate extends orthogonally from the main plate and the first plate of the bracket and the main plate of the adaptor plate are configured to attach to the substrate.

In one embodiment, the bracket further comprises a resiliently biased clip mechanism wherein the clip mechanism comprises a connective form extension comprising a first end connected to the first plate and second end remote from the first end wherein the second end is spaced apart from the first plate such that a gap is formed between the clip mechanism and the first plate.

In one embodiment, the bracket further comprises side walls extending orthogonally from first plate and/or second plate such that side walls are spaced apart from each other by width W of the bracket.

In one embodiment, the bracket further comprises a detent at the junction between the first plate and the second plate.

For the purposes of this specification, the term 'comprise' shall have an inclusive meaning. Thus, it is understood that it should be taken to mean an inclusion of not only the listed components it directly references, but also non specified components. Accordingly, the term 'comprise' is to be attributable with as broad an interpretation as possible and this rationale should also be used when the terms 'comprised' and/or 'comprising' are used.

Further aspects or embodiments of the present disclosure will become apparent from the ensuing description which is given by way of example only.

BRIEF DESCRIPTION OF THE DRAWINGS

Certain embodiments of the present disclosure will now be described, by way of example only, with reference to the accompanying drawings. From figure to figure, the same or similar reference numerals are used to designate similar components of an illustrated embodiment.

FIG. 1(*b*) is a side view of the exemplary bracket of FIG. 1(*a*);

FIG. 1(*c*) is a perspective view of the exemplary bracket of FIG. 1(*a*);

FIG. 2(*b*) is a side view of the exemplary bracket of FIG. 2(*a*);

FIG. 2(*c*) is a perspective view of the exemplary bracket of FIG. 2(*a*);

FIG. 3(*b*) is a side view of the exemplary bracket of FIG. 3(*a*);

FIG. 3(*c*) is a perspective view of the exemplary bracket of FIG. 3(*a*);

FIG. 4(*b*) is a side view of the exemplary bracket of FIG. 4(*a*);

FIG. 4(*c*) is a perspective view of the exemplary bracket of FIG. 4(*a*);

FIG. 5(*b*) is a side view of the exemplary bracket of FIG. 5(*a*);

FIG. 5(*c*) is a perspective view of the exemplary bracket of FIG. 5(*a*);

FIG. 6(*b*) is a perspective view of the first exemplary adaptor plate of FIG. 6(*a*);

FIG. 10(*b*) is an end view of a second exemplary rail of the present disclosure;

FIG. 11(*b*) is an end view of the first concealed fastening system of the present disclosure comprising first exemplary rail of FIG. 10(*a*) together with the first exemplary receiver of FIG. 11(*a*);

FIG. 11(*c*) is an end view of a second concealed fastening system of the present disclosure comprising first exemplary rail of FIG. 10(*b*) together with an alternate embodiment of the first exemplary receiver of FIG. 11(*a*);

FIG. 11(*d*) and FIG. 11(*e*) are an end view and a top view respectively of a second exemplary receiver of the present disclosure;

FIG. 11(*f*) and FIG. 11(*g*) are an end view and a top view respectively of a third exemplary receiver of the present disclosure;

FIG. 11(*h*) and FIG. 11(*i*) are an end view and a top view respectively of a fourth exemplary receiver of the present disclosure;

FIG. 12(*b*) is a perspective view of a second exemplary sub assembly of the present disclosure the first exemplary adaptor plate of FIG. 6(*a*) together with the first exemplary receiver of FIG. 11(*h*);

FIG. 13(*b*) is a perspective view of a fourth exemplary concealed fastening system of the present disclosure;

FIG. 13(*c*) is a perspective view of a fifth exemplary concealed fastening system of the present disclosure;

FIG. 17(*b*) to FIG. 17(*e*) are a series of perspective views of the installation process of the exemplary concealed fastening system of the present disclosure;

DETAILED DESCRIPTION OF THE PREFERRED EMBODIMENTS

Figure 1A:
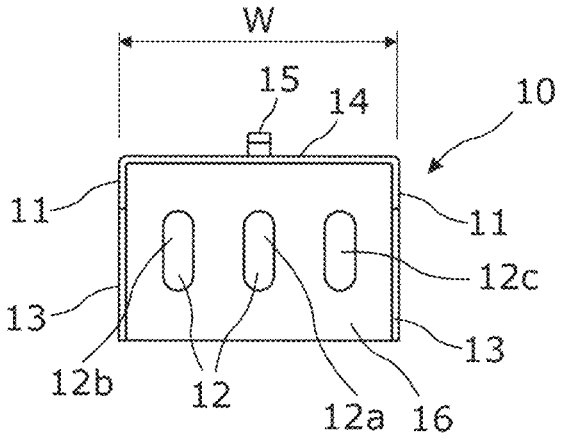
FIG. 1(*a*) is a front view of a first exemplary bracket of the present disclosure.

In the description that follows, like parts may be marked throughout the specification and drawings with like reference numerals. The drawing figures are not necessarily to scale and certain features may be shown exaggerated in scale or in somewhat generalized or schematic form in the interest of clarity and conciseness. It should be understood that the measurements of provided for each of the features of the embodiments of the components of the concealed fastening system in the following disclosure are exemplary measurements for each of these features. The measurements of the embodiments can be adjusted as appropriate by a person skilled in the art in to scale the components to make larger or smaller components whilst achieving the functionality of the concealed fastening system.

Figure 10A:
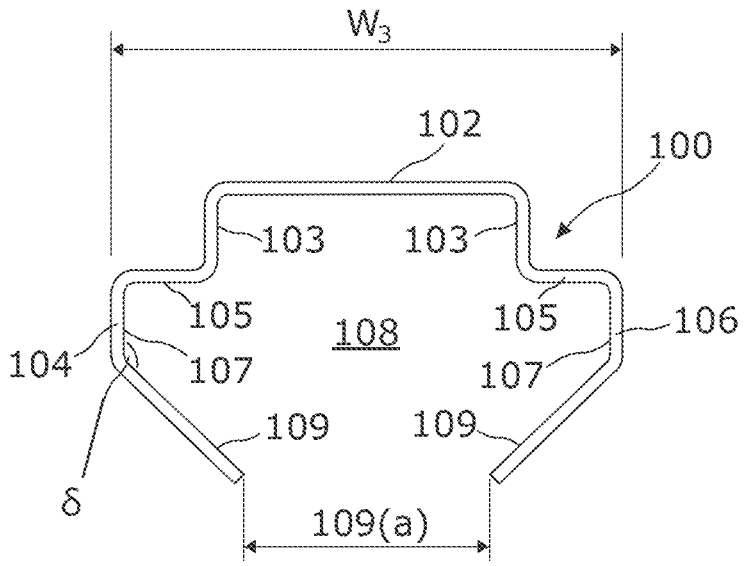
FIG. 10(*a*) is an end view of a first exemplary rail of the present disclosure.
Figure 10B:
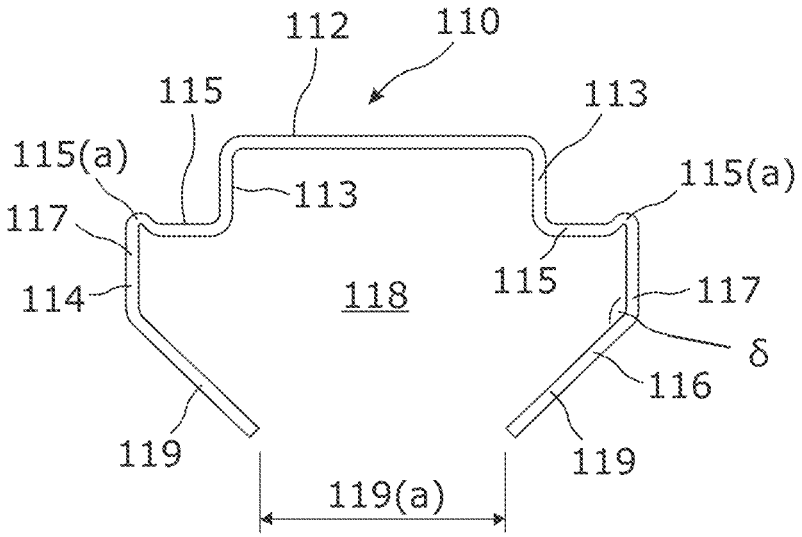
Figure 11A:
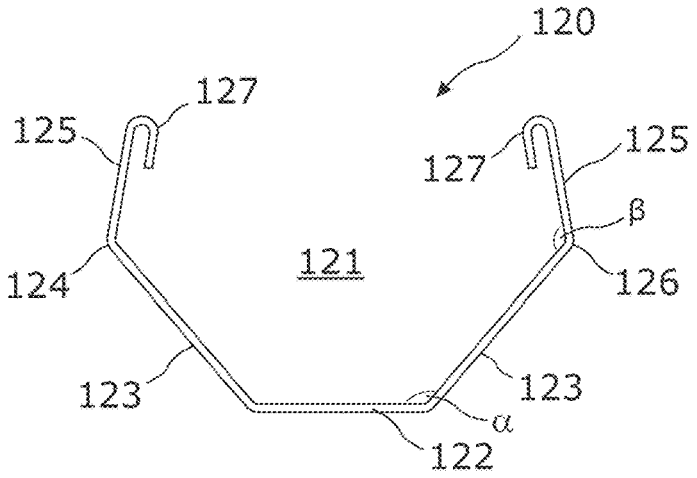
FIG. 11(*a*) is an end view of a first exemplary receiver of the present disclosure.
Figure 11B:
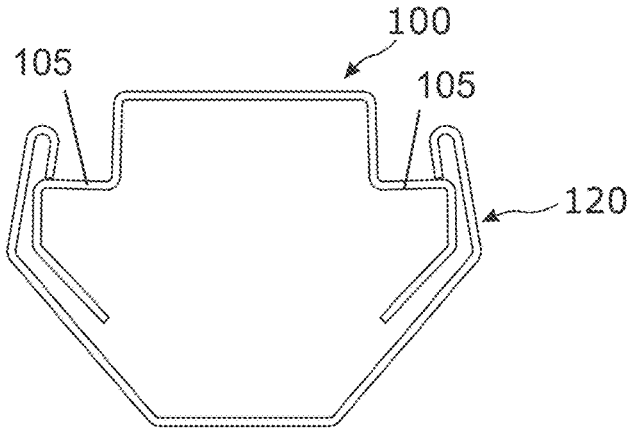
Figure 11C:
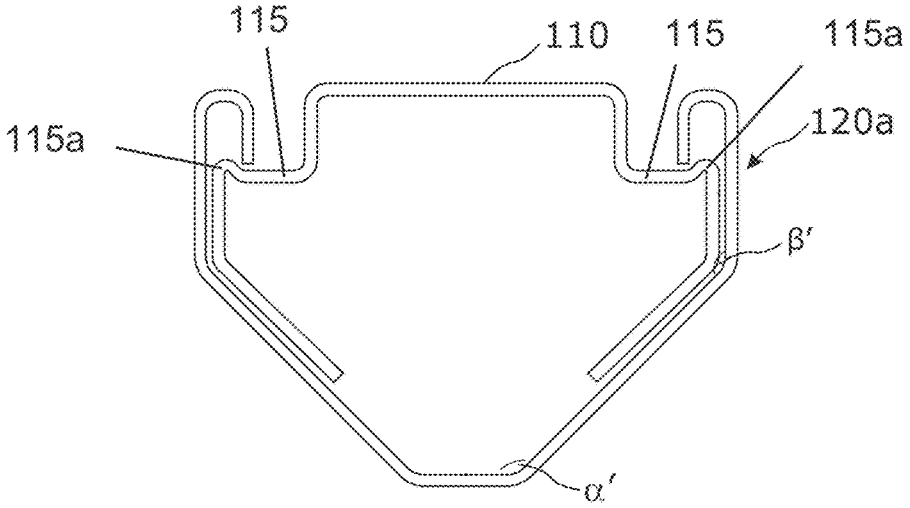
Figure 11D:
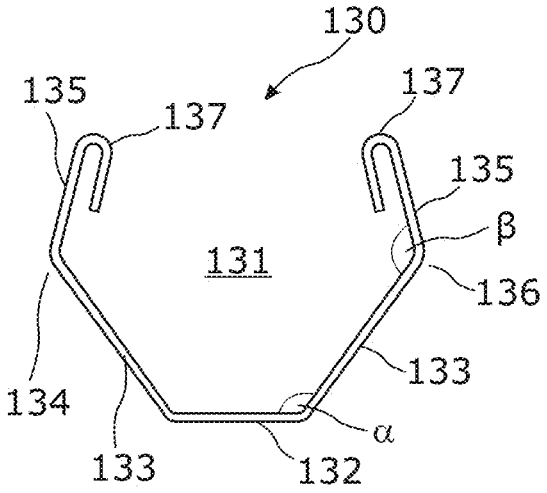
Figure 11F:
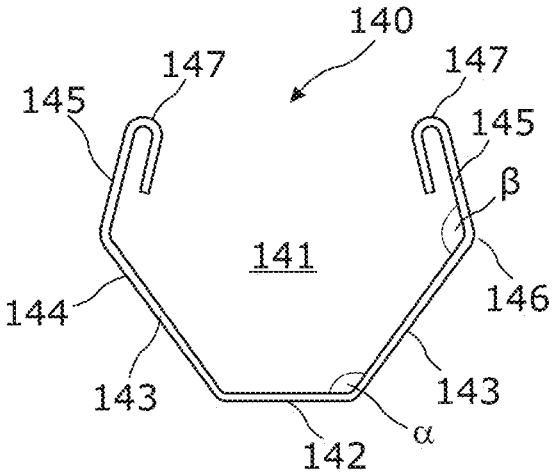
Figure 11E:
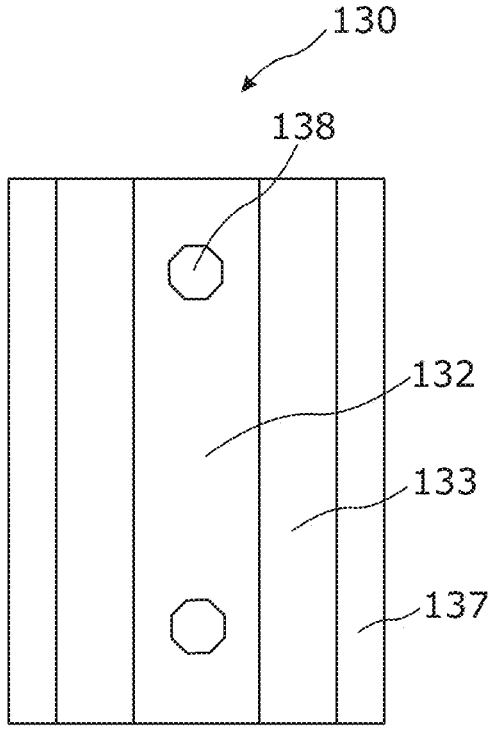
Figure 11G:
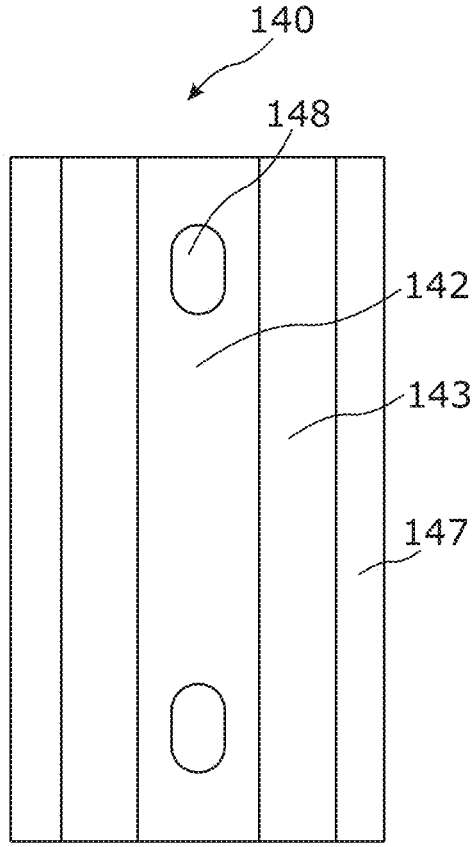
Figure 11H:
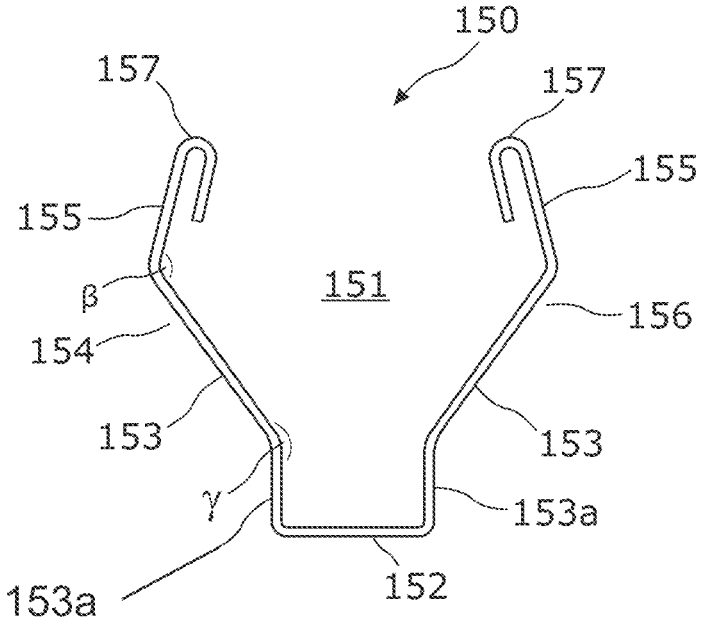
Figure 11I:
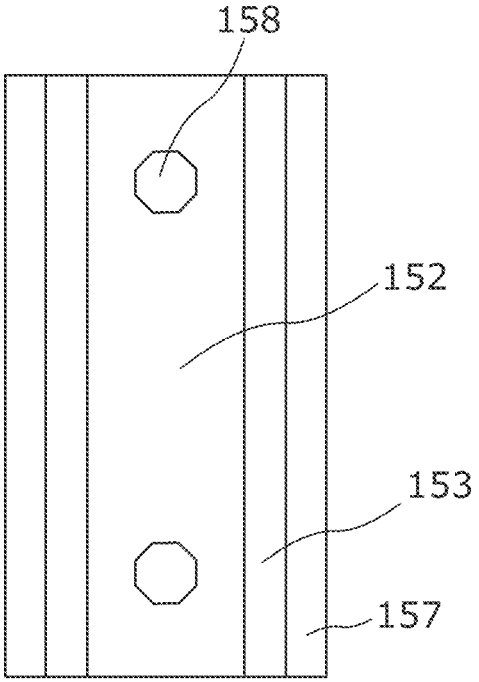

The concealed fastening system of the present disclosure is suitable for attaching or mounting one or more cladding elements 300 to a substrate 320. With reference to FIGS. 10(*a*), 11(*a*), and 11(*b*), in one embodiment of the present disclosure, the concealed fastening system comprises a receiver 120 comprising a base section 122 and side sections 124, 126 extending from the base section 122 such that a central cavity 121 is formed, each side section 124, 126 remote from the base section 122 terminates in a hook 127; and a rail 100 comprising a base element 102 and side arms 104, 106 extending from the base element 102. The rail 100 at least partially seats within the central cavity 121 of the receiver 120 such that the side arms 104, 106 of the rail 100 abut hooks 127 of receiver 120 and the base section 122 of the receiver 120 and the base element 102 of the rail 100 are spaced apart from each other by a distance as will be described more fully below. The base section 122 of the receiver 120 and the base element 102 of the rail 100 are each configured to be secured to either of the substrate 320, shown in FIG. 17(*a*), or the cladding elements 300, shown in shown in FIG. 17(*b*), such that the concealed fastening system of the present disclosure can be used whereby the receiver 120 is attached to the substrate 320 and the rail 100 is attached to the cladding element 300 or vice versa as desired by the end user and as disclosed more fully below.

In a further embodiment of the present disclosure, the concealed fastening system of the present disclosure further comprises a bracket 10, 20, 30, 40, 50 and adaptor plate 60, 70, 80 as will be disclosed more fully below with reference to FIGS. 1(*a*)-9. The addition of bracket 10, 20, 30, 40, 50 and adaptor plate 60, 70, 80 components enable an installer/end user to overcome any surface defects or uneven surfaces on a substrate 320 (e.g., substrate 320 of FIGS. 17(*b*)-17(*e*)), when installing the concealed fastening system of the present disclosure.

All optional and essential components of the concealed fastening system of the present disclosure will now be described in more detail. For the purposes of the following the concealed fastening system will be disclosed with just the receiver 120 and rail components and also with the bracket 10, 20, 30, 40, 50, adaptor plate 60, 70, 80, receiver 120, 120*a*, 130, 140, 150, and rail components.

Each of the following components of the concealed fastening system of the present disclosure may be formed from a range of materials including, but not limited to, metals such as steel or aluminum, or polymeric materials such as fiber reinforced polymer composites. It is preferable when using metals such as steel that the steel grades have mechanical properties which are equivalent to or exceed the requirements specified in EN 10346 2015 as associated with structural steel grades DX51, S220 and S450.

Figure 1B:
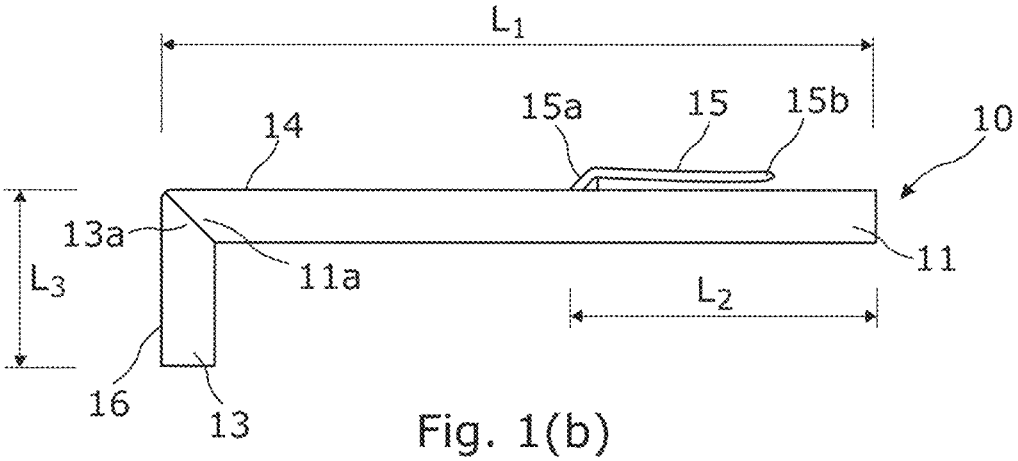
Figure 1C:
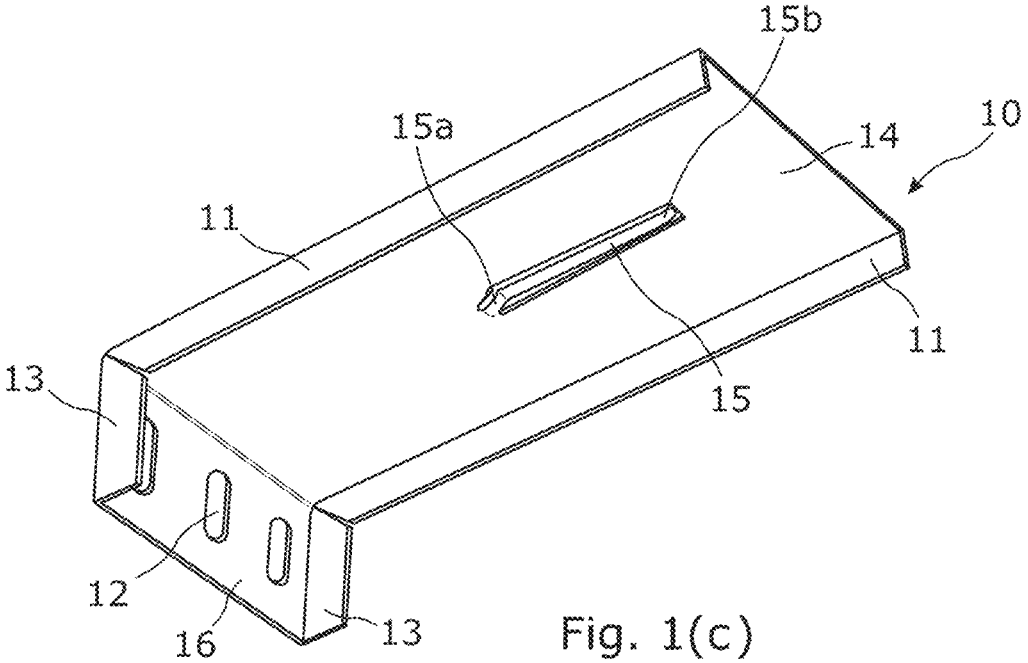

Referring now to FIGS. 1(*a*)-5(*c*), there are shown exemplary brackets 10, 20, 30, 40, 50 of the present disclosure. Each of brackets 10, 20, 30, 40, 50 are substantially 'L-shaped' brackets comprising a first plate 14, 24, 34, 44, 54 and a second plate 16, 26, 36, 46, 56 wherein the second plate 16, 26, 36, 46, 56 extends substantially orthogonally from the first plate 14, 24, 34, 44, 54. In each of the exemplary brackets 10, 20, 30, 40, 50, one or more apertures 12, 22, 32, 42, 52 are provided in second plate 16, 26, 36, 46, 56. In use, exemplary brackets 10, 20, 30, 40, 50 are secured to a substrate (e.g., substrate 320 of FIGS. 17(*b*)-17(*e*)) using appropriate fasteners which are secured to the substrate (e.g., substrate 320 of FIGS. 17(*b*)-17(*e*)) through one or more apertures 12, 22, 32, 42, 52 as will be disclosed more fully below.

Referring now specifically to FIGS. 1(*a*)-1(*c*), the apertures 12 of first exemplary bracket 10 comprise an elliptical or rounded oblong shape. This configuration of the apertures 12 allows for adjustments during installation if so desired. It should be understood that the configuration of any one of the one or more apertures 12, 22, 32, 42, 52 in each of the exemplary brackets 10, 20, 30, 40, 50 can vary to accommodate various types of fasteners and/or substrates. For example, with reference to FIG. 1(*a*), the one or more apertures 12 can be configured to comprise a central aperture 12*a* to allow for an appropriate fastener to be used to secure the exemplary brackets 10, 20, 30, 40, 50 of the present disclosure to a concrete or masonry substrate, and one or more further apertures 12*b*, 12*c* surrounding the central aperture 12*a* to allow an appropriate fastener to be used to secure the exemplary brackets 10, 20, 30, 40, 50 of the present disclosure to a timber or metal (for example steel) substrate. Further exemplary configurations of apertures suitable for use are apertures 42, 52 shown in exemplary brackets 40 and 50 respectively. An installer can select the appropriate configuration of aperture(s) 12, 22, 32, 42, 52 to use to secure the exemplary brackets 10, 20, 30, 40, 50 of the present disclosure to a substrate.

First exemplary bracket 10 further comprises side walls 11, 13. Side walls 11 extend orthogonally from first plate 14 such that side walls 11 are spaced apart from each other by the width W of first exemplary bracket 10. Similarly, side walls 13 extend orthogonally from second plate 16 such that side walls 13 are spaced apart from each other by the width W of first exemplary bracket 10. Conveniently, edges 11*a* and 13*a* of side walls 11 and 13 are configured to allow the side walls 11 and 13 seat together such that at least a portion of edges 11*a* and 13*a* are abutting edges. In some embodiments side walls 11 and 13 seat together such that at least a portion of side walls 11 and 13 overlap each other. Side walls 11 and 13 provide additional support to exemplary bracket 10 resisting or preventing rotational movement of bracket 10 when under load.

Figure 9:
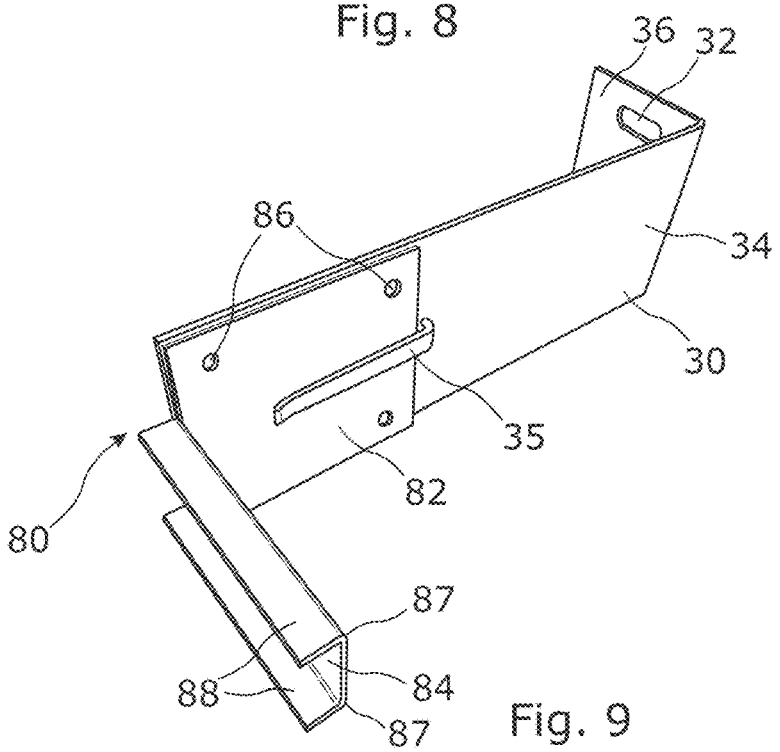
FIG. 9 is a perspective view of the third exemplary adaptor plate of FIG. 8 together with a sixth exemplary bracket of the present disclosure.

The first plate 14 of first exemplary bracket 10 also comprises an optional clip mechanism 15. In the first exemplary embodiment of the bracket 10 shown, clip mechanism 15 comprises a connective form extension which comprises a first end 15*a* connected to first plate 14 and second end 15*b* remote from first end 15*a* and which is spaced apart from first plate 14 such that a gap is formed between clip mechanism 15 and first plate 14. In the embodiment shown, clip mechanism 15 extends from first plate 14 in a direction opposite to that of second plate 16. Clip mechanism 15 is resiliently biased towards the first plate 14 and accommodates the main plate 62, 72, 82 of the exemplary adaptor plates 60, 70, 80. This is illustrated in FIG. 9 and further disclosed below, using the exemplary brackets 10, 20, 30, 40, 50 and exemplary adaptor plates 60, 70, 80. It should be readily understood that clip mechanism 15 is configured to provide a resilient bias and can adopt any configuration known a person skilled in the art which will achieve this functionality. For example, in an alternate exemplary embodiment clip mechanism 15 is configured to have a 'duck bill profile' a profile that is recognized by a person skilled in the art to provide a resilient bias. It should also be understood that first exemplary bracket 10 can comprise more than one clip mechanism if so desired.

Figure 6A:
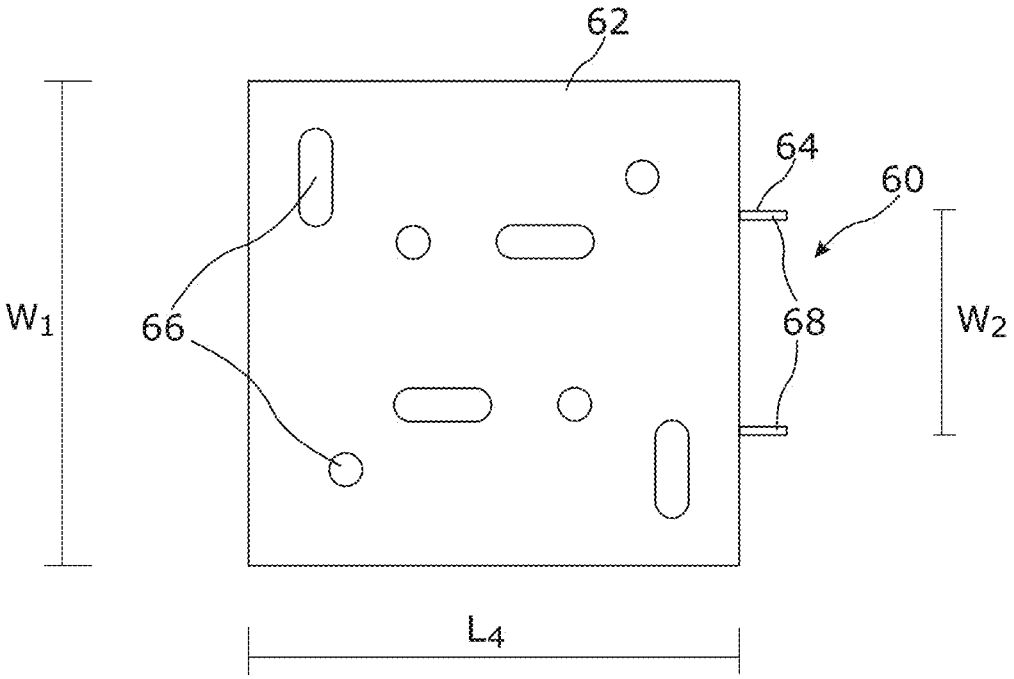
FIG. 6(*a*) is a back view of a first exemplary adaptor plate of the present disclosure.
Figure 6B:
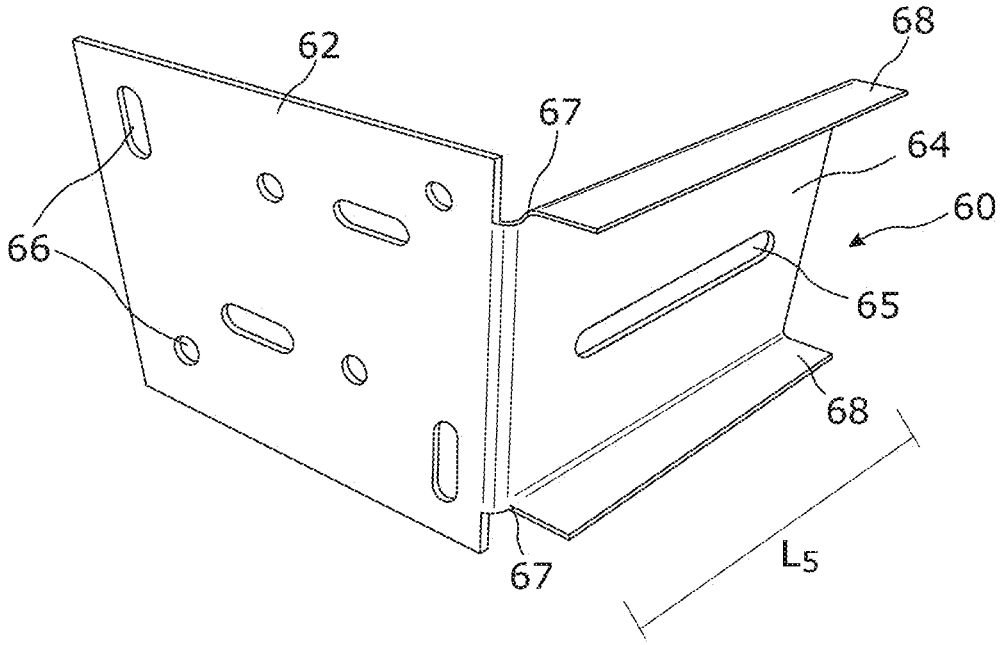
Figure 7:
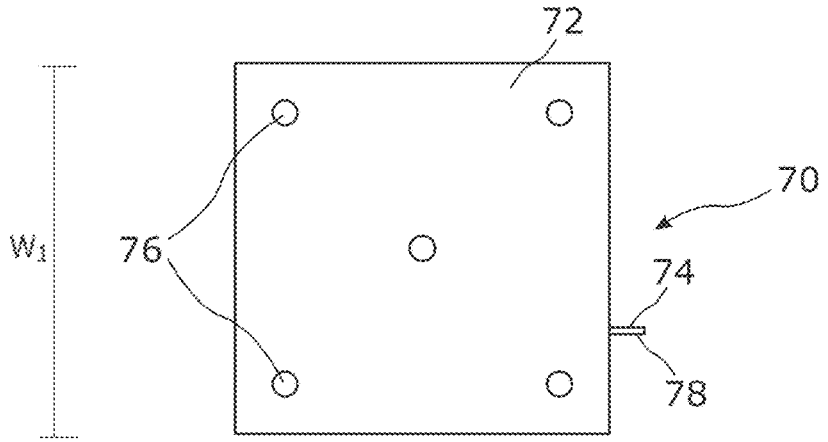
FIG. 7 is a back view of a second exemplary adaptor plate of the present disclosure.
Figure 8:
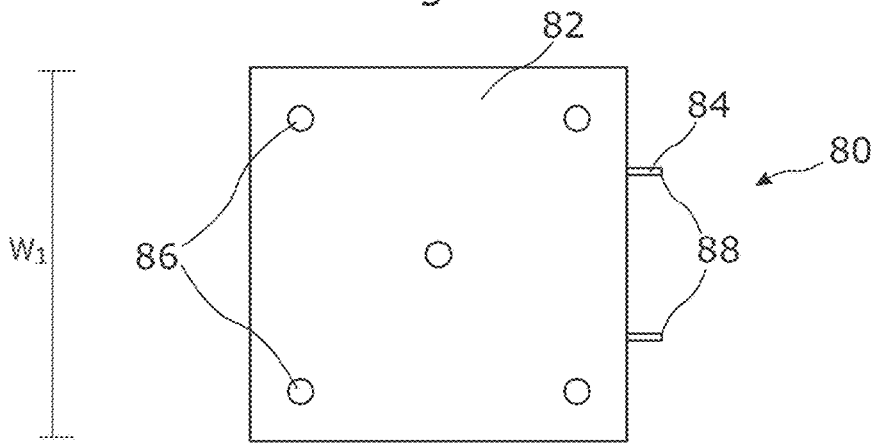
FIG. 8 is a back view of a third exemplary adaptor plate of the present disclosure.

The width W of each of exemplary brackets 10, 20, 30, 40, 50 is variable and ranges between 50 to 200 mm+/−1.0 mm. First exemplary bracket 10 comprises a width W that is approximately 80 mm wide+/−1.0 mm. The length $L_1$ of the first plate 14, 24, 34, 44, 54 of exemplary brackets 10, 20, 30, 40, 50 is also variable and ranges between 40 mm and 400 mm+/−1.0 mm. Distance $L_2$ will be described with reference to first exemplary bracket 10 and is the distance between first end 15*a* and the end of first plate 14 remote from second plate 16. However, it should be understood that distance $L_2$ between the first end 15*a* of the clip mechanism 15 and the edge of the first plate 14 remote from the second plate 16 can be influenced by the length $L_4$ of the adaptor plate 60 as shown in FIG. 6(*a*). In the embodiment shown, distance $L_2$ of first exemplary bracket 10 is approximately 85 mm+/−1.0 mm however this can be altered as required to accommodate the range of measurements provided for $L_4$ below. The length $L_3$ of second plate 16 is also variable and can range between approximately 50 mm to 100 mm+/−1.0 mm.

Figure 2A:
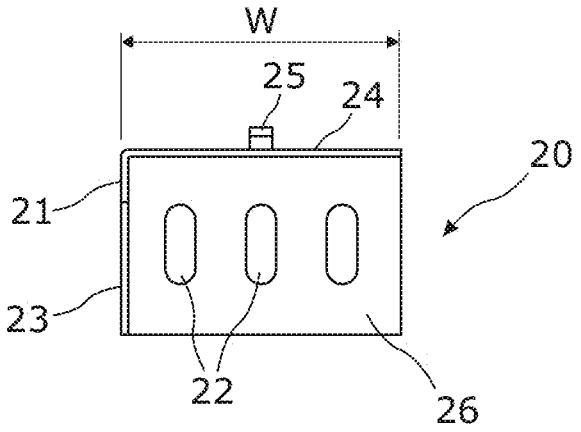
FIG. 2(*a*) is a front view of a second exemplary bracket of the present disclosure.
Figure 2B:
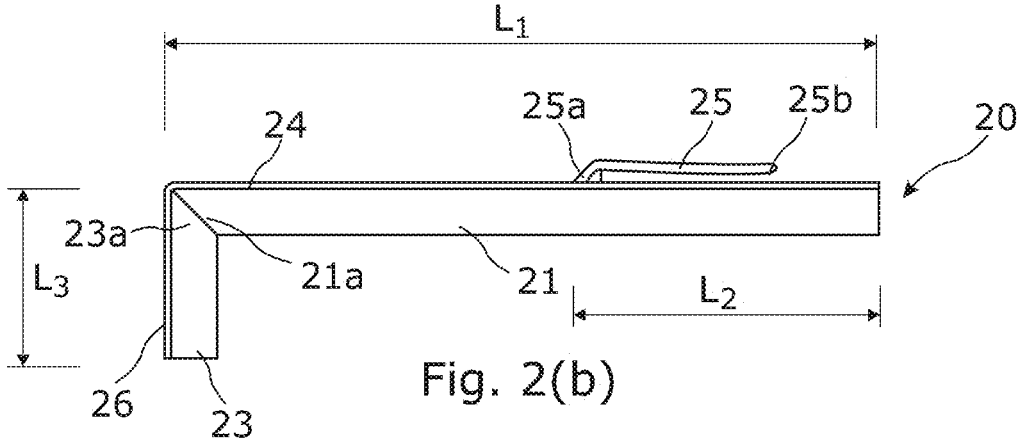
Figure 2C:
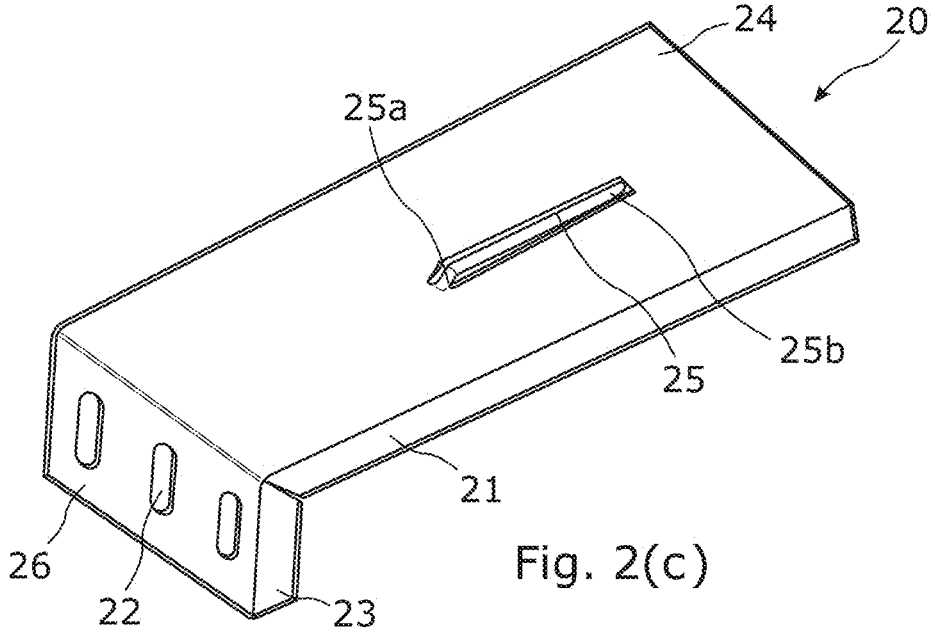

Second exemplary bracket 20 as shown in FIGS. 2(*a*)-2(*c*) differs from that of first exemplary bracket 10 in that second exemplary bracket 20 has side walls 21, 23 on one side of bracket 20 only. As before, side walls 21 and 23 provide additional support to exemplary bracket 20 resisting or preventing rotational movement of bracket 20 when under load. In some embodiments, the side walls 21 and 23 have edges 21*a* and 23*a* respectively, configured to allow the side walls 21 and 23 to seat together such that at least a portion of edges 21*a* and 23*a* abut. In some further embodiments, the first plate 24 of the second exemplary bracket 20 has a clip mechanism 25 comprising a first end 25*a* connected to the first plate 24 and a second end 25*b* remote from the first end 25*a* and which is spaced apart from the first plate 24 such that a gap is formed between clip mechanism 25 and first plate 24. Further, the clip mechanism 25 extends from first plate 24 in a direction opposite to that of second plate 26.

Figure 3A:
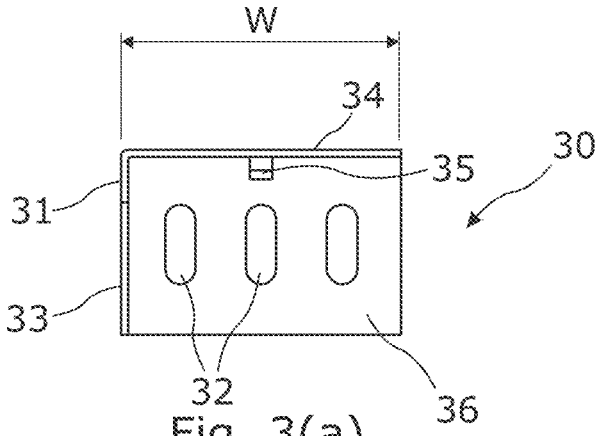
FIG. 3(*a*) is a front view of a third exemplary bracket of the present disclosure.
Figure 3B:
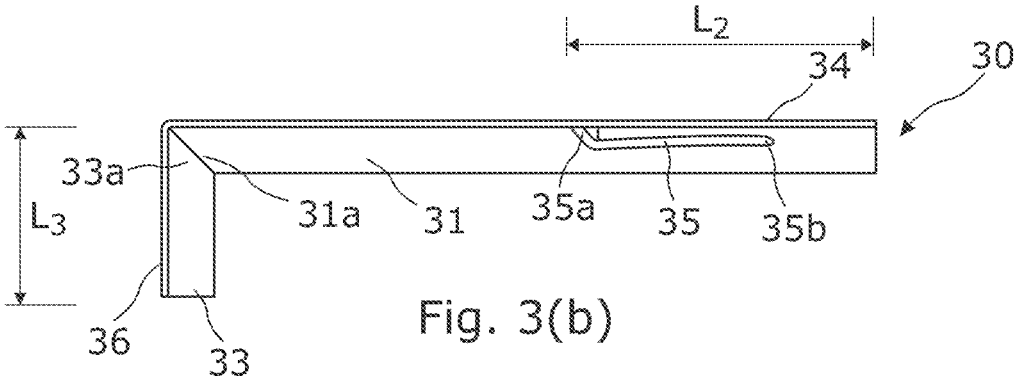
Figure 3C:
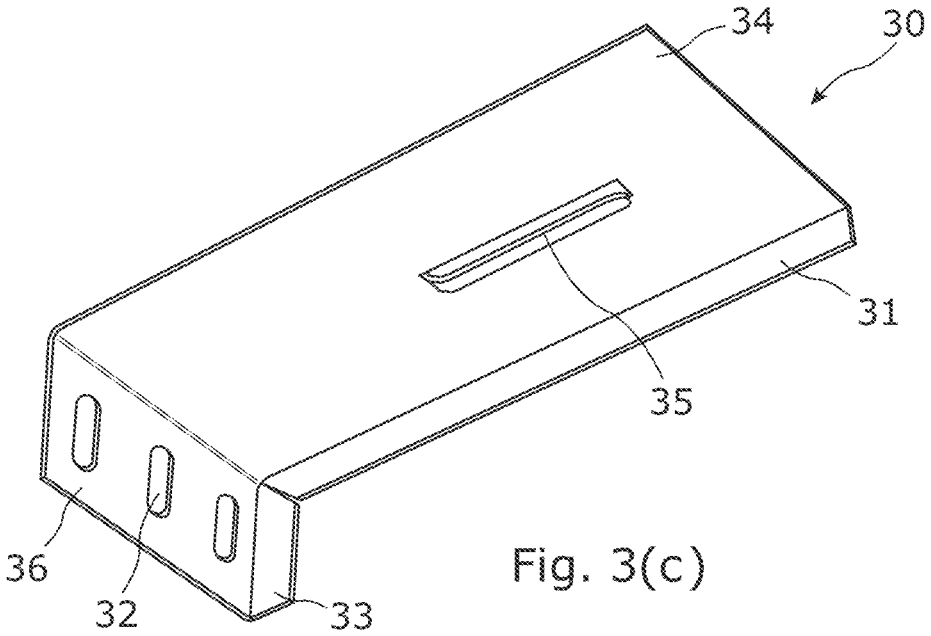

Third exemplary bracket 30 as shown in FIGS. 3(*a*)-3(*c*) differs from that of the second exemplary bracket 20 in that the clip mechanism 35 of the third exemplary bracket 30 extends from first plate 34 in the same direction as that of second plate 36. As before, the clip mechanism 35 can have a first end 35*a* connected to the first plate 334 and a second end 35*b* spaced apart from the first plate 34. In some further embodiments, side walls 31 and 33 provide additional support to exemplary bracket 30 resisting or preventing rotational movement of bracket 30 when under load. The side walls 31 and 33 have edges 31*a* and 33*a* respectively, configured to allow the side walls 31 and 33 to seat together such that at least a portion of edges 31*a* and 33*a* are abutting edges.

Figure 4A:
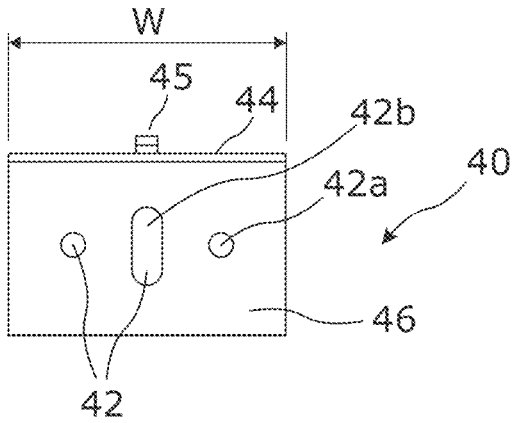
FIG. 4(*a*) is a front view of a fourth exemplary bracket of the present disclosure.
Figure 4B:
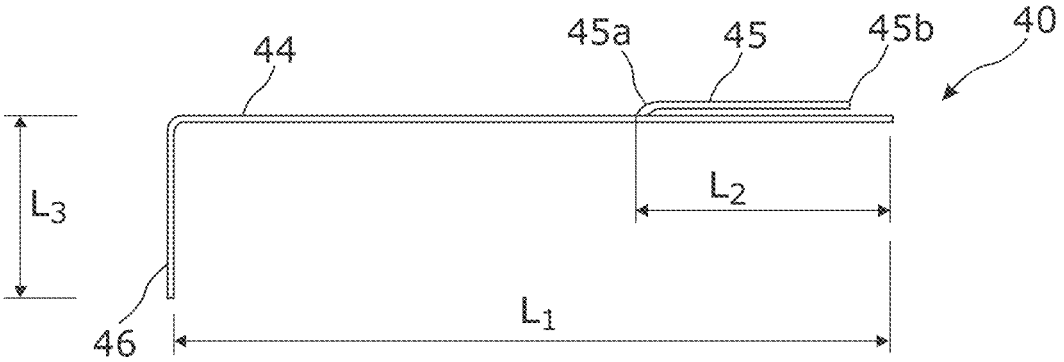
Figure 4C:
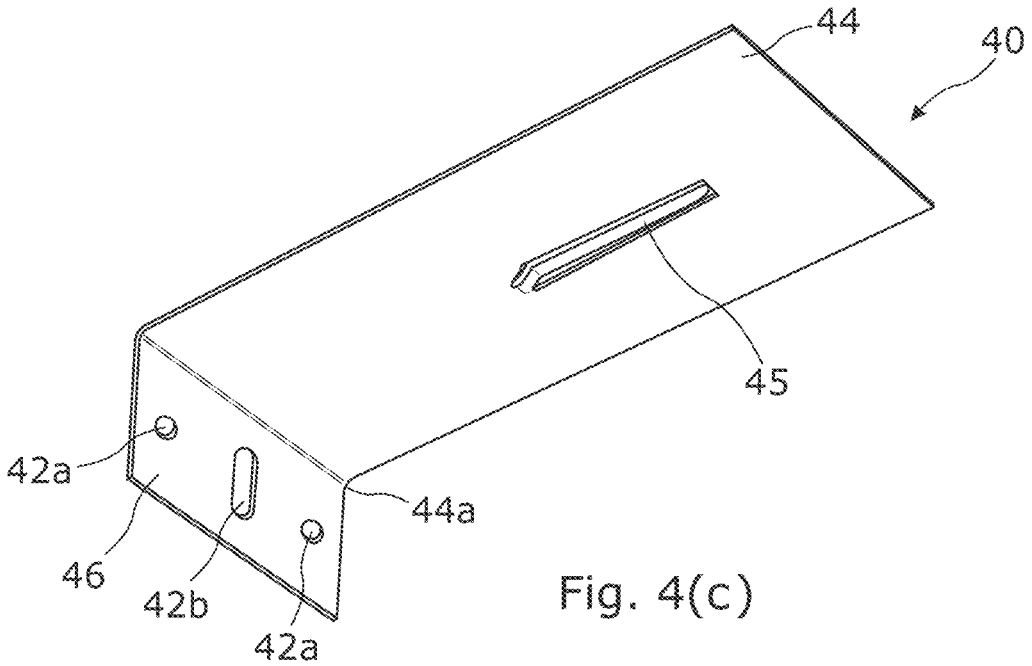

Fourth exemplary bracket 40 as shown in FIGS. 4(*a*)-4(*c*) differs from that of first exemplary bracket 10 in that fourth exemplary bracket 40 has no side walls. Fourth exemplary bracket 40 further comprises a detent 44*a* at the junction between the first plate 44 and the second plate 46 to prevent rotation of the first plate 44 relative to the second plate 46 when under load. Additionally, the configuration of apertures 42 of fourth exemplary bracket 40 comprises circular outer apertures 42*a* and a central oblong aperture 42*b*. In some further embodiments, the first plate 44 of the fourth exemplary bracket 40 can have a clip mechanism 45 comprising a first end 45*a* connected to the first plate 44 and a second end 45*b* remote from the first end 45*a* and which is spaced apart from the first plate 44 such that a gap is formed between clip mechanism 45 and first plate 44. Further, the clip mechanism 45 extends from first plate 44 in a direction opposite to that of second plate 46. It should be readily understood that apertures 42 could also be configured as described above with respect to the each of the first to third embodiments of exemplary brackets 10, 20, and 30.

Figure 5A:
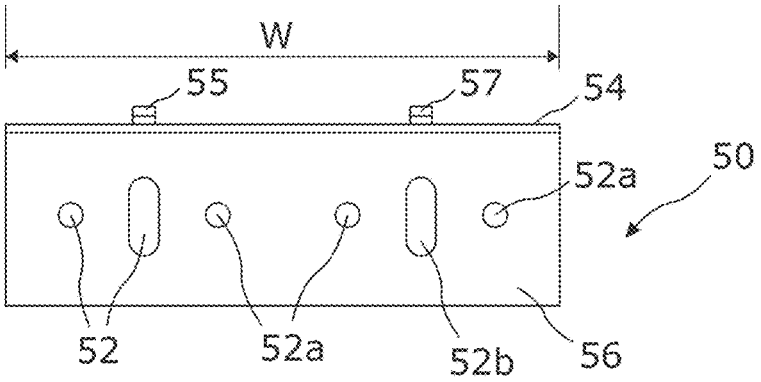
FIG. 5(*a*) is a front view of a fifth exemplary bracket of the present disclosure.
Figure 5B:
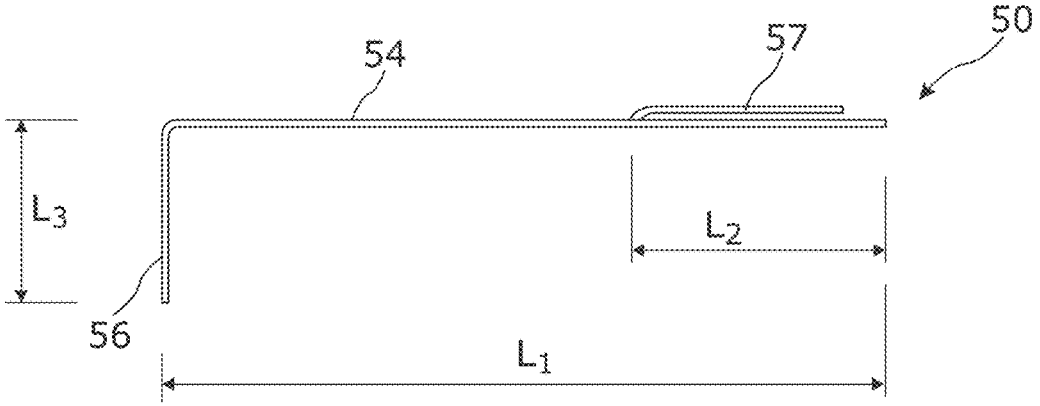
Figure 5C:
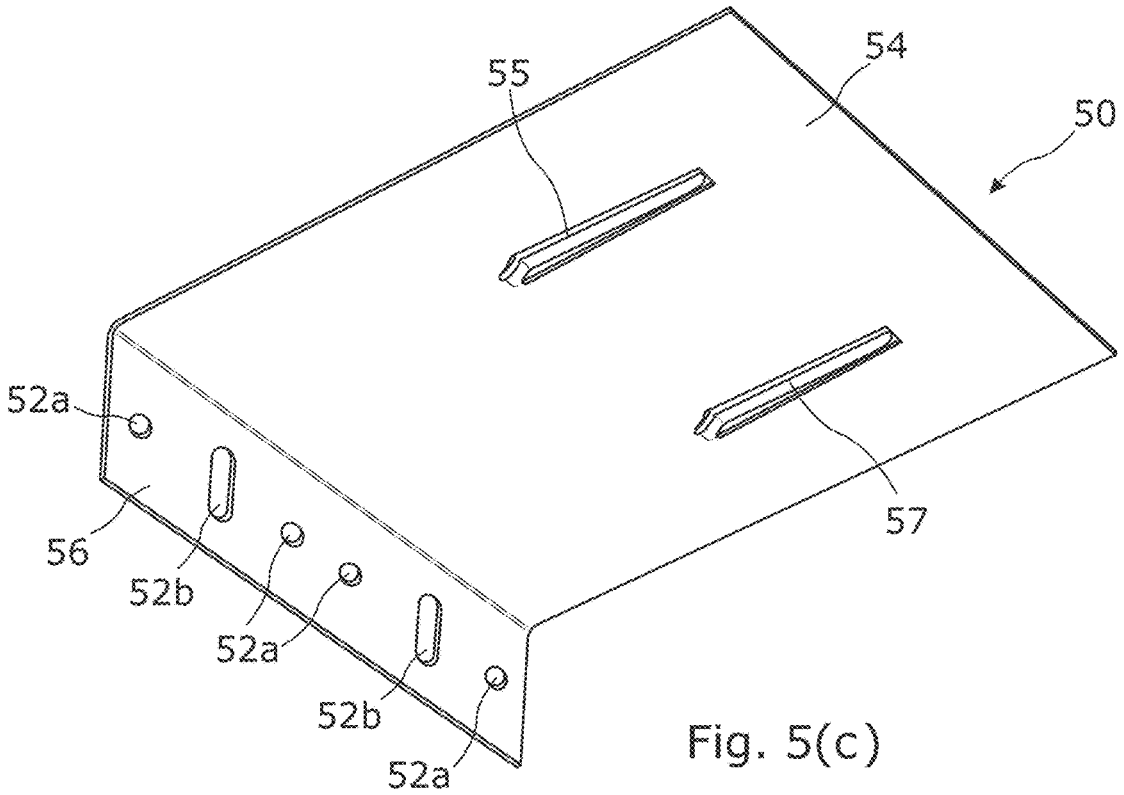

Fifth exemplary bracket 50 as shown in FIGS. 5(*a*)-5(*c*) is similar to that of fourth exemplary bracket 40, however in this exemplary embodiment the width W of fifth exemplary bracket 50 is approximately 150 mm+/−1.0 mm wide. In some embodiments, the first plate 54 of the fifth exemplary bracket 50 has a clip mechanism 55. Fifth exemplary bracket 50 can further comprises a second clip mechanism 57 in first plate 54 and additional apertures in second plate 56. Second clip mechanism 57 is as described above in relation to clip mechanism 15 of first exemplary bracket 10. Additionally, the second plate 56 can have apertures 52. The apertures 52 of the fifth exemplary bracket 50 can comprise circular outer apertures 52*a* and a central oblong aperture 52*b*. It should be understood that each of the differentiating features of the respective exemplary embodiments of brackets 10, 20, 30, 40, 50 are interchangeable and any one or more of those features can be used in any combination with each of the substantially 'L-shaped' exemplary brackets.

Referring now to FIGS. 6(*a*)-8, there are shown exemplary adaptor plates 60, 70, 80 of the present disclosure. Adaptor plates 60, 70, 80 are substantially 'L-shaped' comprising main plate 62, 72, 82 and secondary plate 64, 74, 84 wherein the secondary plate 64, 74, 84 extends substantially orthogonally from the main plate 62, 72, 82. Main plate 62, 72, 82 further comprises a plurality of openings 66, 76, 86. In use, the plurality of openings 66, 76, 86 allow the main plate 62, 72, 82 to be secured to the first plate 14, 24, 34, 44, 54 of the exemplary brackets 10, 20, 30, 40, 50 as will be described more fully below with respect to FIG. 9.

Figure 15:
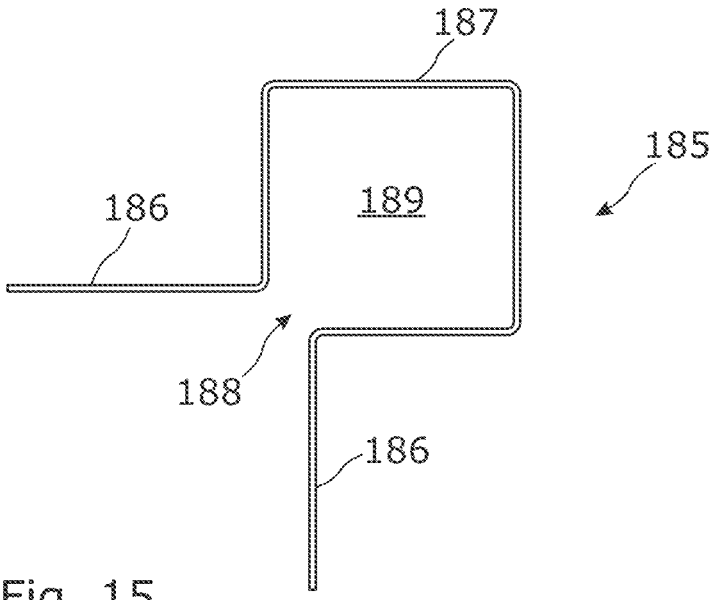
FIG. 15 is an end view of an exemplary external corner profile of the present disclosure.
Figure 16:
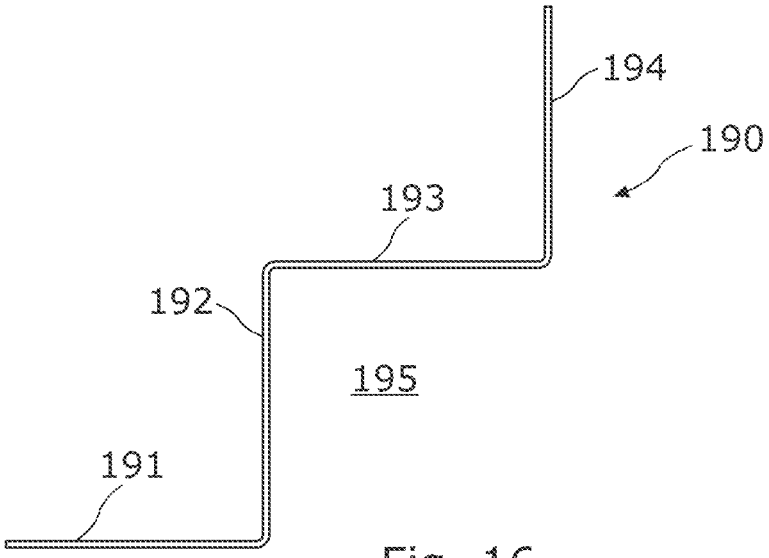
FIG. 16 is an end view of an exemplary internal corner profile of the present disclosure.
Figure 17A:
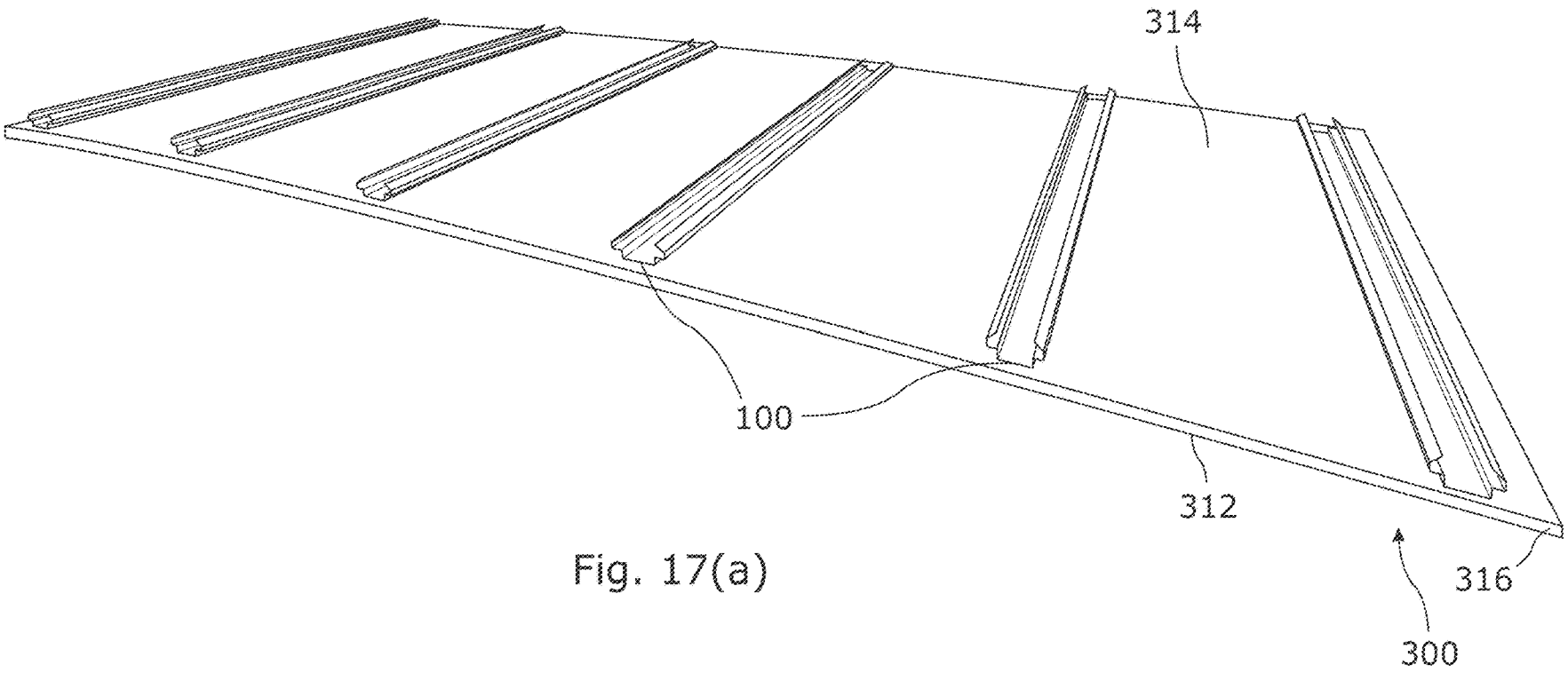
FIG. 17(*a*) is a perspective view of the rear face of panel with the first exemplary rail of FIG. 10 attached.
Figure 17B:
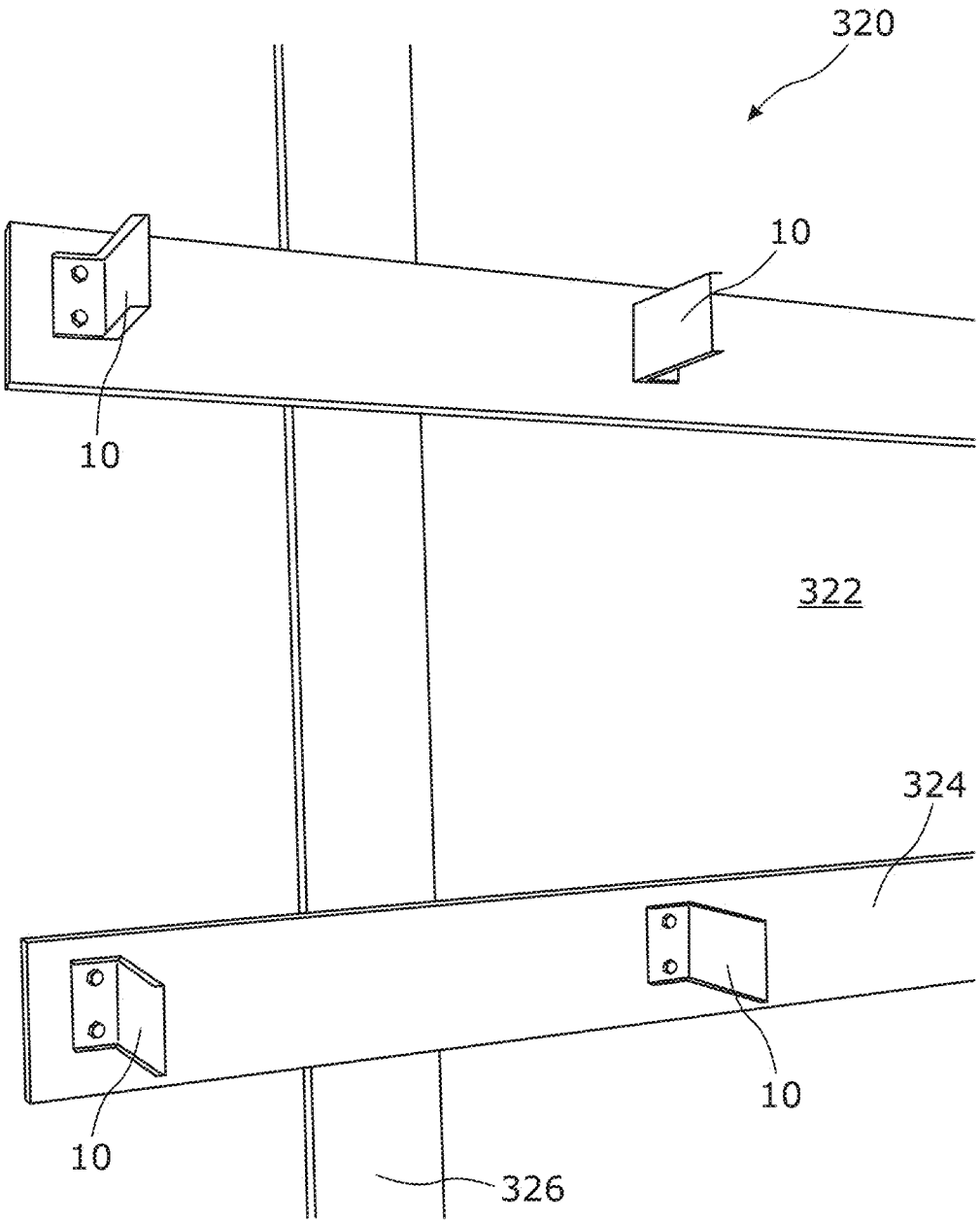
Figure 17C:
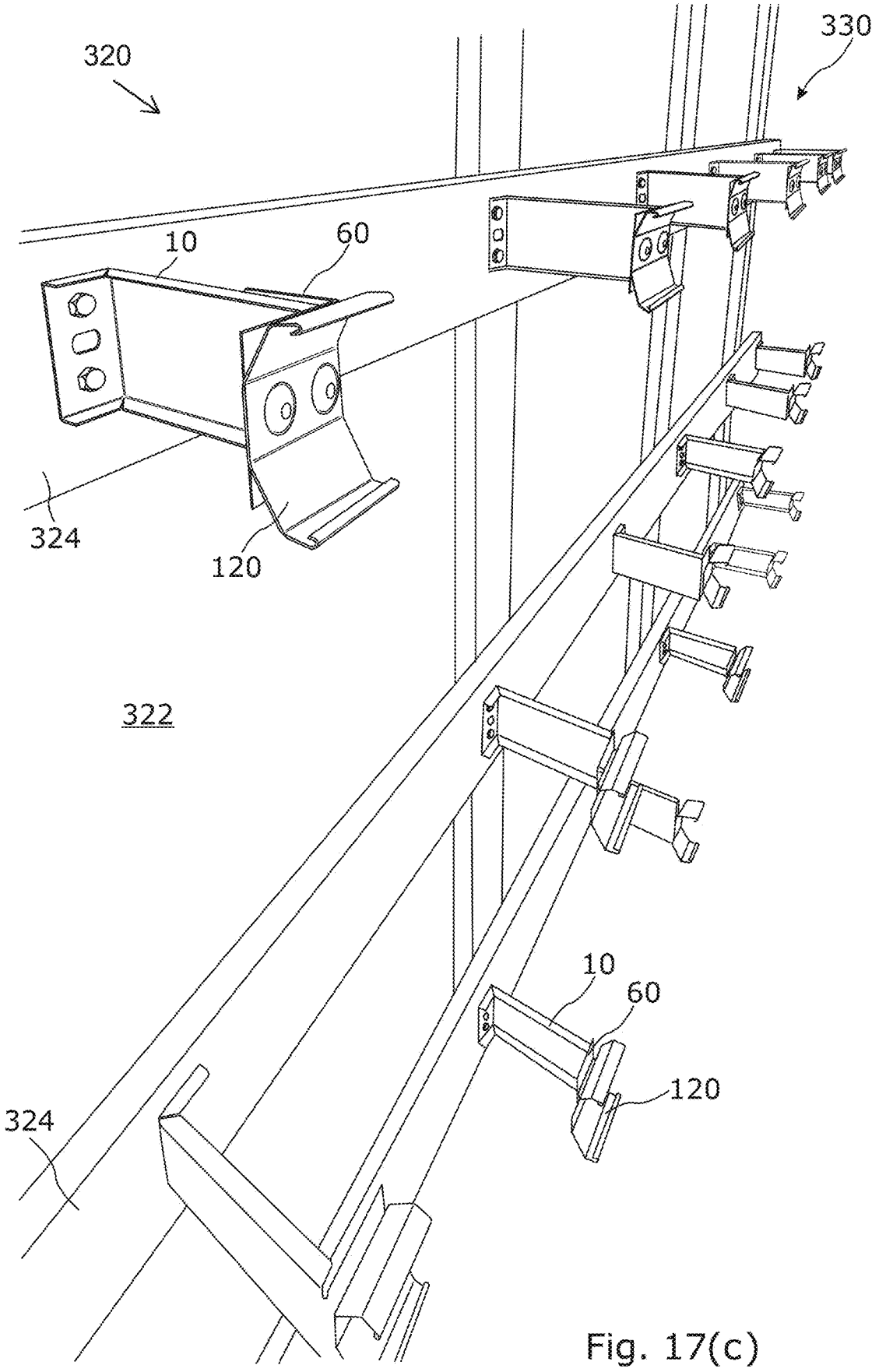
Figure 17D:
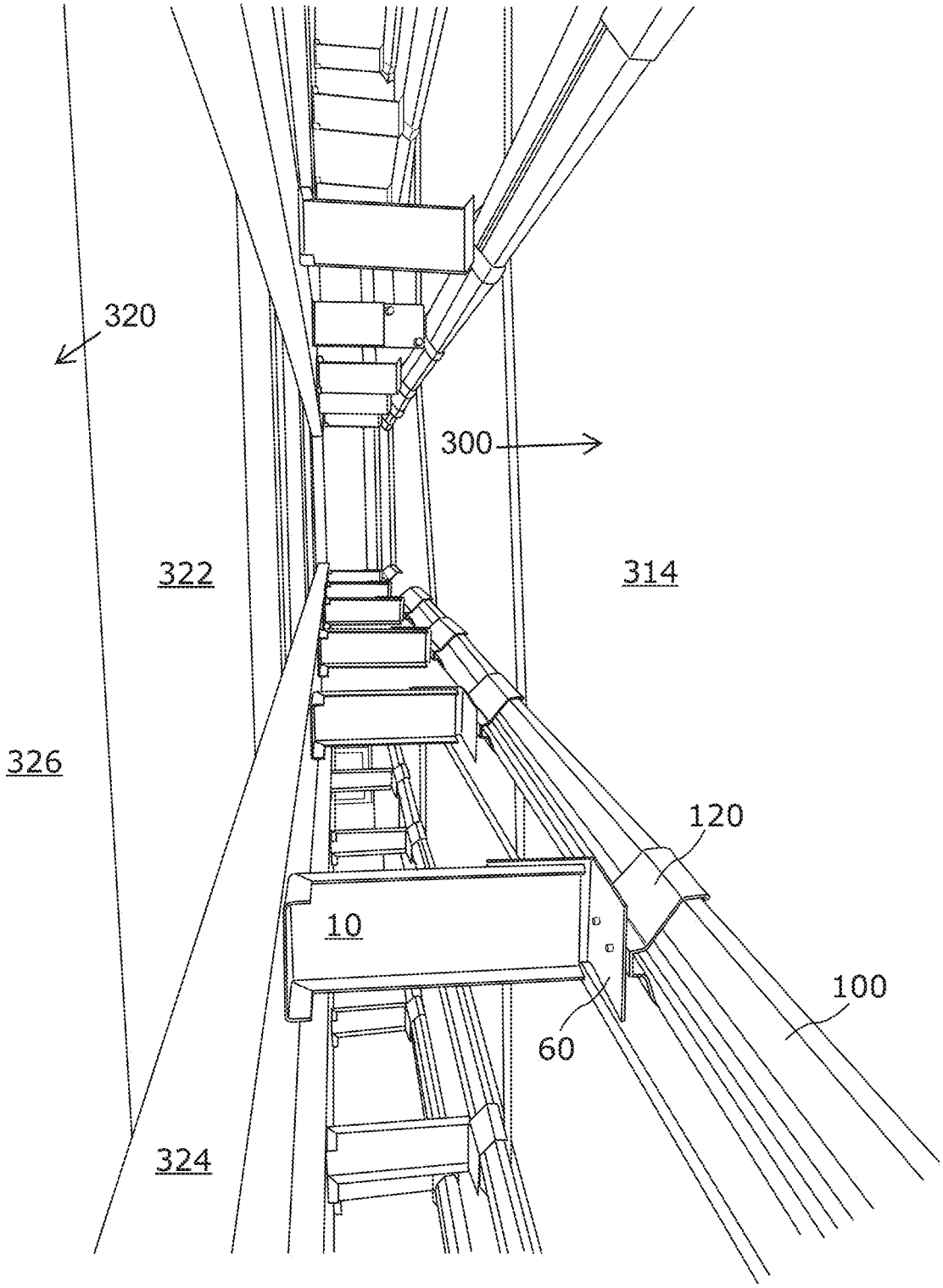
Figure 17E:
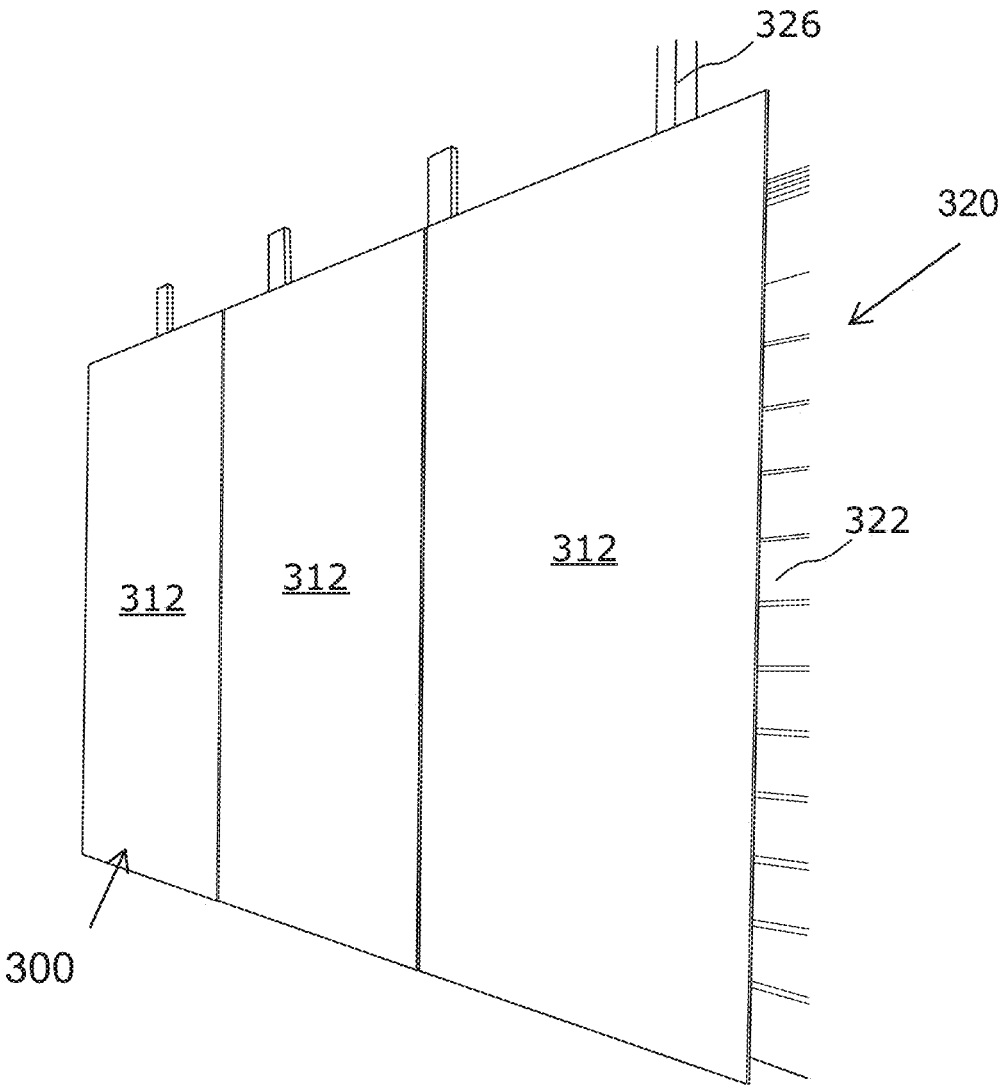
Figure 18A:
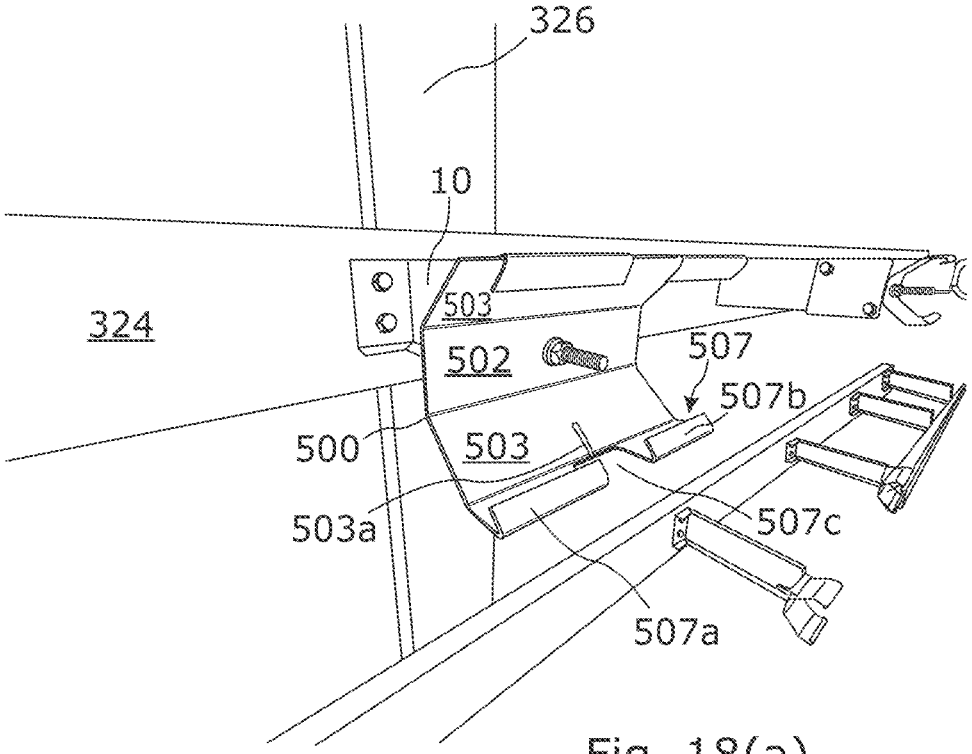
FIG. 18(*a*) to FIG. 18(*d*) are a series of perspective views of the installation process of an exemplary concealed fastening system of the present disclosure at a joint between adjacent panels.
Figure 18B:
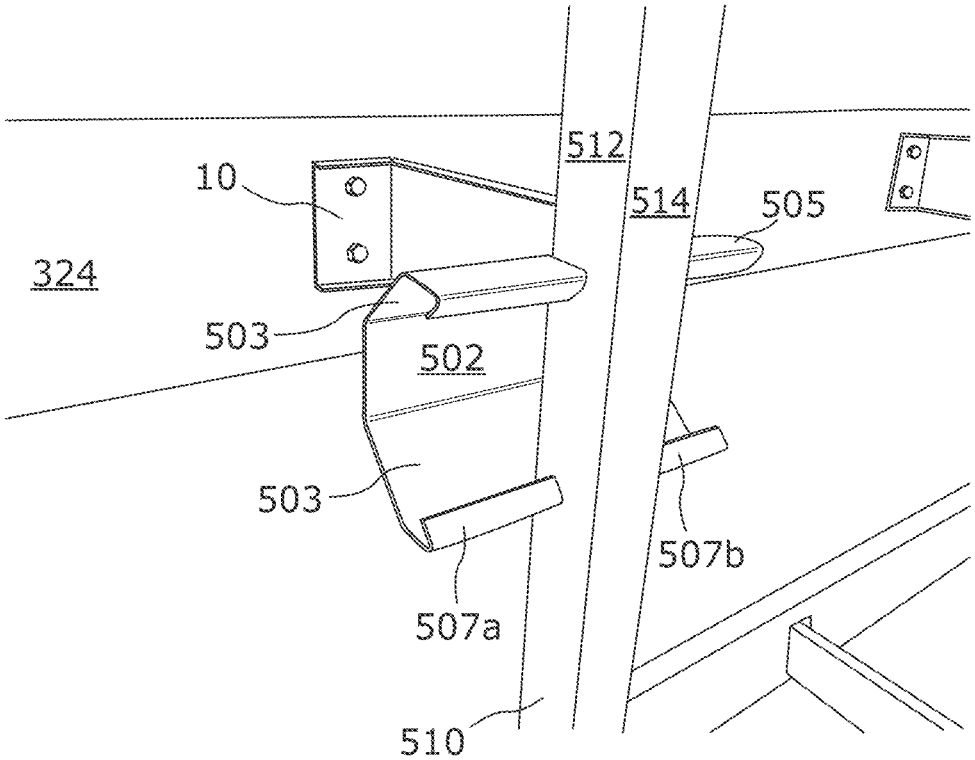
Figure 18C:
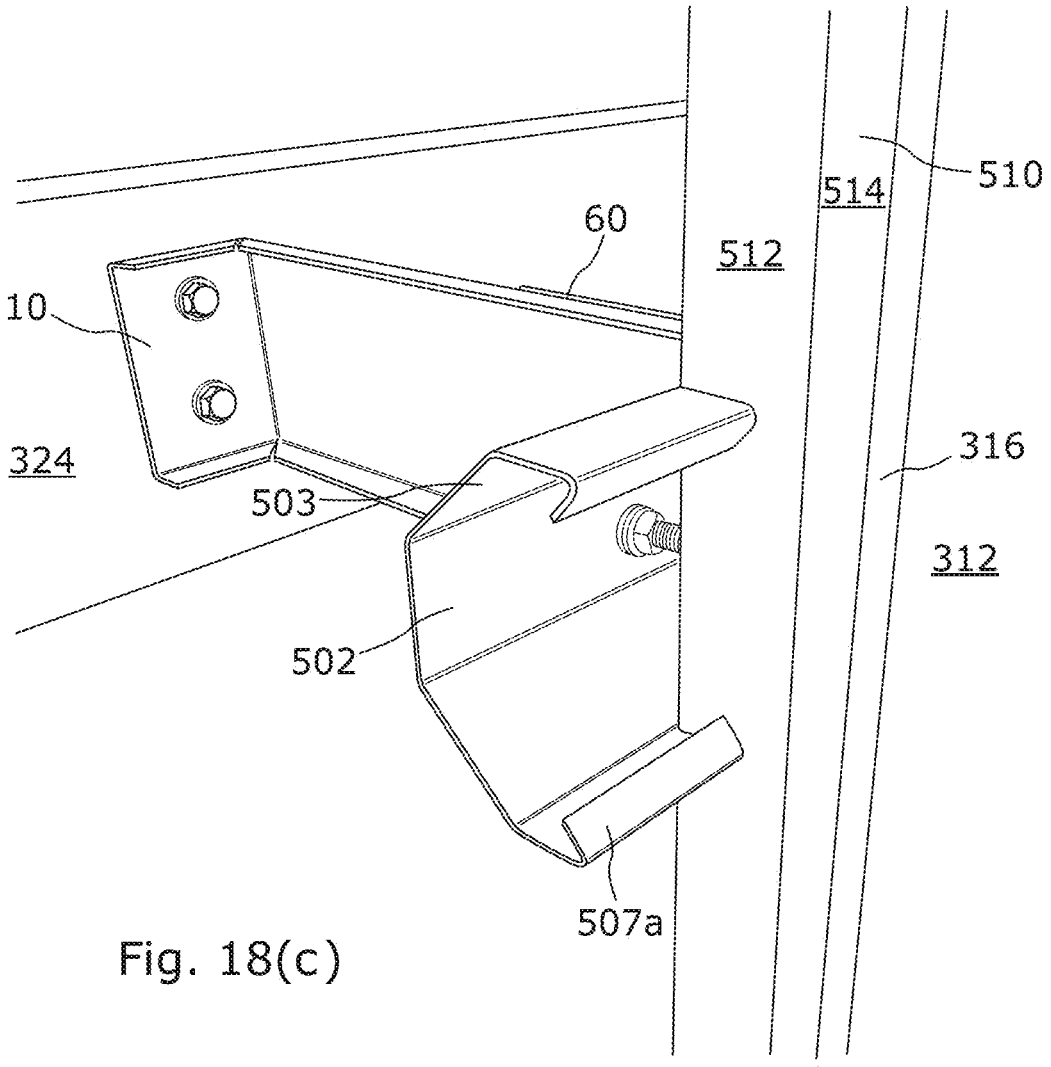
Figure 18D:
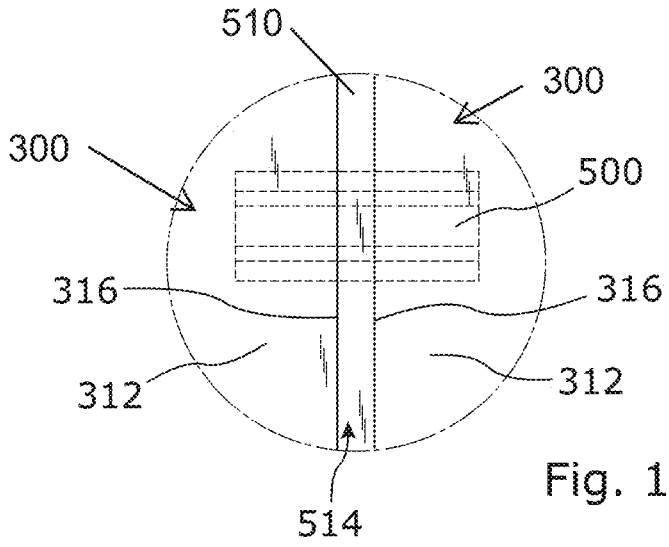

Secondary plate 64, 74, 84 of adaptor plates 60, 70, 80 is further provided with one or more wing member(s) 68, 78, 88, which extend orthogonally from side edges 67, 87 of secondary plate 64, 74, 84 away from main plate 62, 72, 82. Secondary plate 64 of adaptor plate 60 can further comprises an optional elongate opening 65 as shown in FIG. 6(*b*). However, it should be understood that any of the secondary plates 64, 74, 84 of the adaptor plates 60, 70, 80 can comprise the optional elongate opening 65. Elongate opening 65 provides an opening through which fasteners can be positioned to secure additional optional components such as internal and/or external corner trim fixing brackets 185 and 190 as shown in FIGS. 15 and 16 respectively to the concealed fastening system of the present disclosure as will be disclosed more fully below.

In each of the exemplary embodiments of adaptor plates 60, 70, 80, main plate 62, 72, 82 is between approximately 46 mm and 192 mm+/−1.0 mm wide ($W_1$) and between approximately 46 mm and 192 mm+/−1.0 mm long ($L_4$) whilst secondary plate 64, 74, 84 is between approximately 33 mm and 135 mm+/−1.0 mm wide ($W_2$) and between approximately 75 mm and 180 mm+/−1.0 mm long ($L_5$). However, it should be understood that these dimensions are variable. In one embodiment the width $W_1$ of the main plate 62, 72, 82 of the exemplary adaptor plate 60, 70, 80 is approximately 4% to 8% less than the width W of the first plate 14, 24, 34, 44, 54 of the exemplary brackets 10, 20, 30, 40, 50. It is desirable for the main plate 62, 72, 82 of the adaptor plate 60, 70, 80 and the first plate 14, 24, 34, 44, 54 of the bracket 10, 20, 30, 40, 50 to have such an overlap between the main plate 62, 72, 82 of the adaptor plate 60, 70, 80 and the first plate 14, 24, 34, 44, 54 of the bracket 10, 20, 30, 40, 50 to allow for load transfer and load distribution from the adaptor plate 60, 70, 80 across the width W of the first plate 14, 24, 34, 44, 54 of the bracket 10, 20, 30, 40, 50. In a further embodiment of the present disclosure, it is also possible for the width $W_1$ to be equal to or more than 8% less than the width W of the first plate 14, 24, 34, 44, 54 of the exemplary brackets 10, 20, 30, 40, 50. In such instances, the width $W_1$ of the main plate 62, 72, 82 of the exemplary adaptor plate 60, 70, 80 is approximately 4% to 75% less than the width W of the first plate 14, 24, 34, 44, 54 of the exemplary brackets 10, 20, 30, 40, 50. The width $W_2$ of secondary plate 64, 74, 84 is also variable and is dependent on the width of base element 102, 112 of rail 100, 110 as shown in FIGS. 10(*a*) and 10(*b*) and described more fully below.

With reference to the exemplary embodiments of the present disclosure and specifically with reference to the first exemplary bracket 10 wherein width W of first plate 14 of bracket 10 is approximately 80 mm wide+/−1.0 mm, width $W_1$ of main plate 62, 72, 82 is approximately 5% less than the width W of first plate 14 or approximately 1475 mm+/−1.0 mm wide. Turning now to exemplary bracket 50 as shown in FIGS. 5(*a*)-8, wherein width W of first plate 54 is approximately 150 mm wide+/−1.0 mm, the width $W_1$ of the main plate 62, 72, 82 of exemplary adaptor plate 60, 70, 80 is approximately 5% less than the width W of exemplary bracket 50 or approximately 142.5 mm+/−1.0 mm wide.

Exemplary adaptor plates 60, 70, 80 can seat together with exemplary brackets 10, 20, 30, 40, 50. As shown in FIG. 9, main plate 82 of exemplary adaptor plate 80 is placed on exemplary bracket 30 and seated under clip mechanism 35. Clip mechanism 35 is resiliently biased towards the main plate 82 of exemplary adaptor plate 80 thereby holding exemplary adaptor plate 80 in position on exemplary bracket 30. Although not shown, additional fasteners are inserted through openings 86 to further secure exemplary adaptor plate 80 to exemplary bracket 30. It should be understood that in some instances clip mechanism 35 may not be present and in such embodiments, fasteners inserted through openings 86 will retain the adaptor plate 80 in position on exemplary bracket 30.

Figure 13A:
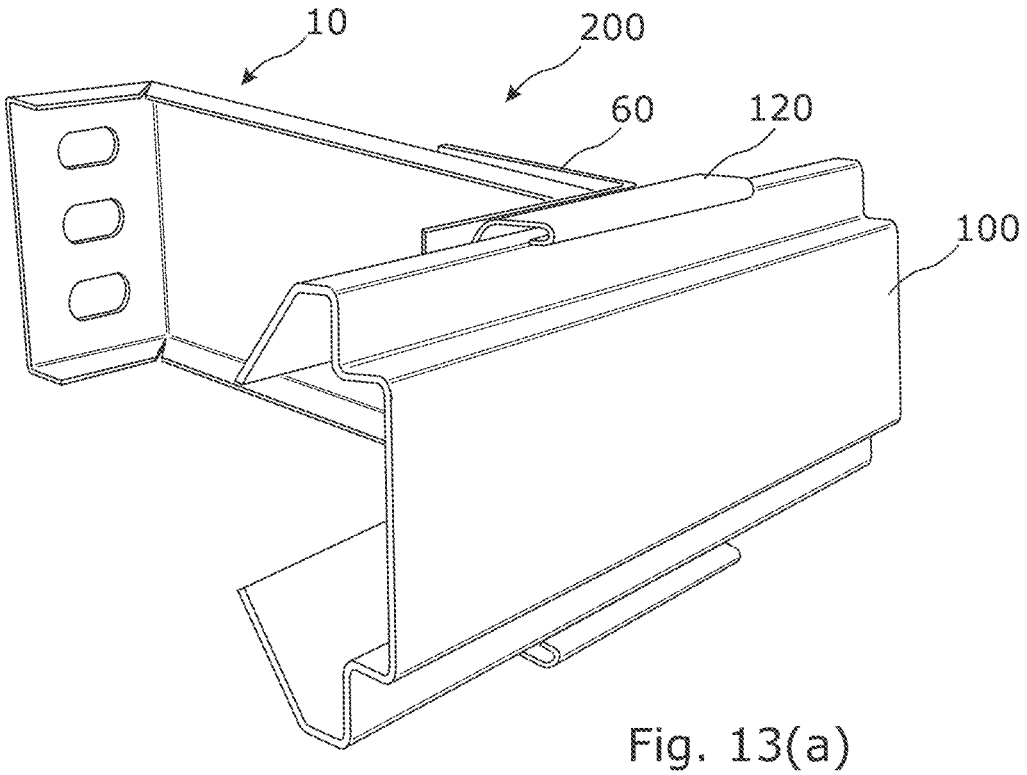
FIG. 13(*a*) is a perspective view of a third exemplary concealed fastening system of the present disclosure.
Figure 13B:
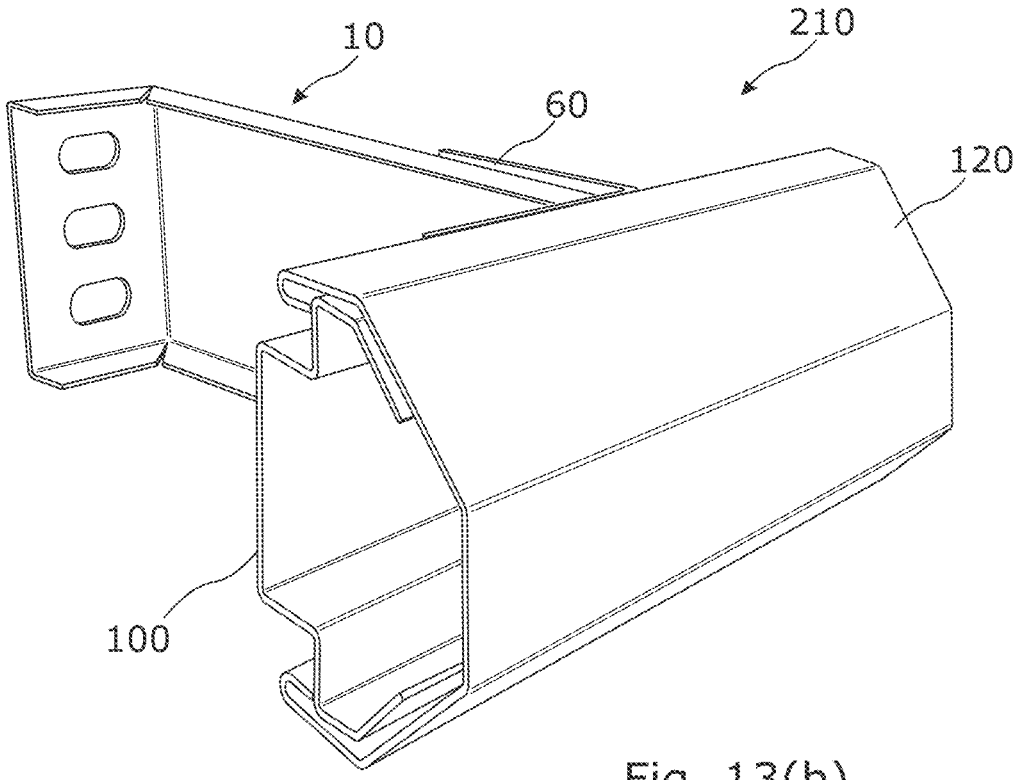
Figure 13C:
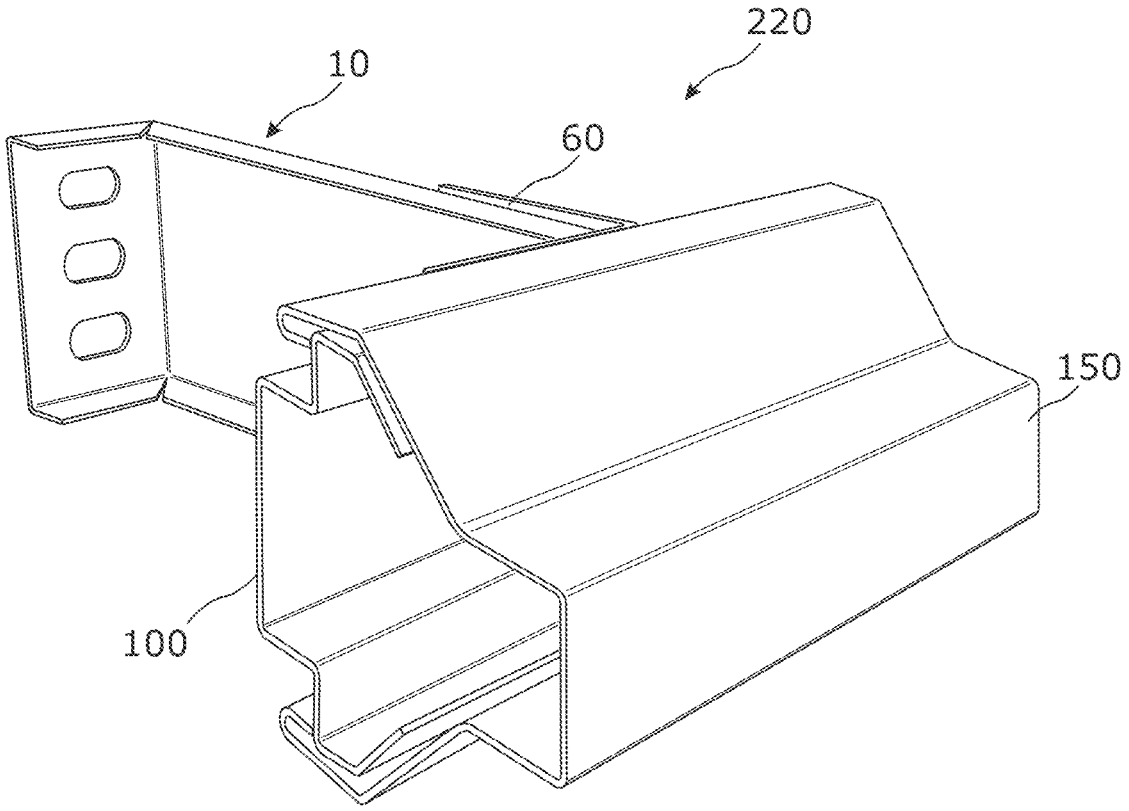

Referring now to FIGS. 10(*a*) and 10(*b*), there are shown two exemplary rails 100, 110 of the present disclosure. Exemplary rails 100 and 110 are substantially 'U' shaped articles comprising a base element 102, 112 from which side arms 104, 114, 106, 116 project orthogonally forming a recess 108, 118. Referring specifically to FIG. 10(*a*), side arms 104 and 106 each comprise a first flange 103, wherein first flange 103 extends orthogonally from base element 102 such that side arms 104, 106 extend from base element 102 in the same direction but are spaced apart from each other. Side arms 104 and 106 each further comprise a second flange 105 which extends orthogonally from first flange 103 remote from base element 102 in a direction away from base element 102 such that the second flange 105 extends in a plane parallel to but spaced apart from base element 102. The overall width $W_3$ of exemplary rail 100 is equivalent to the sum of the widths of the base element 102 and each of the second flanges 105 approximately. Overall width $W_3$ ranges between approximately 40 mm and 150 mm+/−1.0 mm. In this exemplary embodiment overall width $W_3$ is approximately 48 mm+/−1.0 mm. The width of the base element 102 is such that the base element 102 can seat easily on either a substrate 320 (e.g., substrate 320 of FIGS. 17(*b*)-17(*e*)) or the rear face 314 of a cladding element 300 or alternatively the secondary plate 64, 74, 84 of exemplary adaptor plates 60, 70, 80 when adaptor plates 60,70, 80 are present in the concealed fastening system of the present disclosure as illustrated in FIGS. 13(*b*) and 17(*d*). The width of the base element 102 is variable. In the present embodiment as shown, the width of base element 102 can be approximately the same as $W_2$, seen in FIG. 6(*a*), and can be approximately 33 mm+/−1.0 mm.

Side arms 104, 114 and 106, 116 each further comprise a third flange 107, 117 which also extends in a direction away from base element 102, 112 however third flange 107, 117 extends orthogonally from second flange 105, 115 in a plane parallel to but spaced apart from first flange 103, 113. Side arms 104, 114 and 106, 116 each further comprise fourth flange 109, 119 which extends at an angle δ from third flange 107, 117 such that the fourth flanges 109, 119 of each side arm 104, 114, 106, 116 extend towards each other forming an opening 109(*a*). Angle δ in the exemplary rails 100, 110 of the present disclosure ranges between approximately 94° and 158°+/−2° and more preferably is between approximately 125° and 145°+/−2°. In the exemplary rails 100, 110 angle δ is approximately 132°+/−2°. The length of exemplary rails 100, 110 ranges between 25 mm+/−1.0 mm and 20 m+/−1.0 cm wherein the length of exemplary rails 100, 110 is the distance between opposing ends of the exemplary rails 100, 110 which is perpendicular to overall width $W_3$. This allows exemplary rails 100, 110 to be in the form of separate discrete elements or elongate elements wherein the elongate elements are immediately recognized as spanning a longer length than the length of each separate discrete elements. In such embodiments one or a plurality of rail elements can be used to mount a cladding element 300 to a substrate 320. Accordingly, the concealed fastening system of the present disclosure could for example mount a cladding element 300 that is 4.2 m or 6 m long using either an elongate rail that is approximately the same length as the cladding element 300 or alternatively, using a plurality of discrete shorter rails that can be spaced apart along the same length as that of the cladding element 300 as desired by the end user.

Referring now to FIG. 10(*b*), exemplary rail 110 differs from that of the rail 100 disclosed in FIG. 10(*a*) in that each of second flange 115 is provided with a nub 115*a* at the junction between second flange 115 and third flange 117. Alternatively, or additionally, exemplary rail 110 can be provided with a groove or slot at the junction between second flange 115 and third flange 117. In the event that the groove or slot is provided in addition to nubs 115(*a*), the groove or slot is provided on second flange 115 between nubs 115(*a*) and first flange 113 to provide a seat for the end of hook 127 of receiver 120 as will be disclosed more fully below. Nubs 115(*a*) and/or grove or slot are provided in exemplary rail 110 to provide additional resistance to prevent the receiver 120*a* from deflecting when in use as will be disclosed more fully below. Like the rail 100 seen in FIG. 10(*a*), the rail 110 seen in FIG. 10(*b*) has side arms 114 and 116 that each further comprise fourth flange 119 which extends at an angle δ from third flange 117 such that the fourth flanges 119 of each side arm 114, 116 extend towards each other forming an opening 119(*a*).

Referring now to FIG. 11(*a*), there is shown a first exemplary receiver 120 of the present disclosure. First exemplary receiver 120 is also a substantially 'U' shaped article with a complimentary configuration to that of the exemplary rail 100, 110. Further exemplary receivers 120*a*, 130, 140, 150 are shown in each of FIGS. 11(*c*)-11(*i*) each of which have substantially the same 'U' shape configuration as that of first exemplary receiver 120. The configuration of each of the exemplary receivers 120, 120*a*, 130, 140, 150 allow the exemplary rails 100, 110 to seat within the cavity 121, 131, 141, 151 of each respective receiver 120, 120*a*, 130, 140, 150 as disclosed more fully below. Accordingly, further exemplary receivers 120*a*, 130, 140, 150 will be described generally in the following with reference to first exemplary receiver 120.

First exemplary receiver 120 comprises a base section 122 from which side sections 124, 126 extend forming a central cavity 121 in the central internal area of the 'U' shaped article. The width of base section 122 is commensurate with base element 102, 112 of exemplary rails 100, 110.

Side sections 124 and 126 each comprise a first projection 123 and a second projection 125, wherein first projections 123 extend at an angle α away from each side of base section 122 and second projections 125 extend at an angle β from the first projection 123 remote from base section 122. In the exemplary embodiments, angle β between first projection 123 and second projection 125 is greater than angle α between first projection 123 and base section 122. Angle β in the exemplary receivers of the present disclosure ranges between approximately 93° and 157°+/−2° and more preferably is between approximately 123° and 143°+/−2°. In the exemplary receivers of the present disclosure ranges, angle β is approximately 131°+/−2°. Angle α in the exemplary receivers 120, 120*a*, 130, 140, 150 of the present disclosure ranges between approximately 92° and 156°+/−2° and more preferably is between approximately 120° and 140°+/−2°. In the exemplary receivers 120, 120*a*, 130, 140, 150 of the present disclosure, angle α in is approximately 125°+/−2°. In the exemplary embodiments of the exemplary receivers 120, 120*a*, 130, 140, 150, angle δ of exemplary rails 100, 110 is equal to or greater than angle β of the exemplary receivers 120, 120*a*, 130, 140, 150 of the present disclosure.

The end of each second projection 125 remote from first projection 123 is provided with a hook 127 in which the curved section is turned towards the central cavity 121. Although not visible in FIG. 11(*a*), base section 122 is further provided with one or more holes to facilitate locating fasteners to allow the rail 100, 110 to be secured to the secondary plates 64, 74, 84 of adaptor plates 60, 70, 80 or alternatively to the rear face 314 of a cladding panel 300 as shown in FIG. 17(*a*). Although element 300 is here referred to as a cladding panel, it should be understood that terms like cladding elements, building panels, and panels can be used interchangeably. Second exemplary receiver 120*a* as shown in FIG. 11(*c*) is similar to first exemplary receiver 120 however first projections 123 extend at an angle α' away from each side of base section 122 and second projections 125 extend at an angle β' from the first projection 123 remote from base section 122.

Although not shown, each of side sections 124 and 126 optionally further comprises one or more small projections or knurls. The one or more small projections are positioned on first projection 123 of side sections 124, 126. The one or more small projections reduce movement of the exemplary rails 100, 110 when seated within exemplary receivers 120, 120*a*, 130, 140, 150 (as further disclosed below) thus reducing noise created by such movement when in use.

Referring now specifically to FIGS. 11(*a*)-11(*c*), there is shown first and second exemplary embodiments of the concealed fastening system of the present disclosure in which rails 100 and 110 respectively are shown seated together with first and second exemplary receivers 120 and 120*a* such that rails 100 and 110 seat within the central cavity 121 of receivers 120 and 120*a* whereby the second flange 105, 115 of rails 100 and 110 abut the hook 127 of receivers 120 and 120*a*. In an alternate embodiment, the ends of hook 127, which abut the second flange 105, 115 of rails 100, 110 seat within a groove or slot provided on the outer surface of second flange 105, 115 to retain the ends of hook 127 in position and provide restraint to prevent the receiver 120, 120*a* from deflecting when in use. The following will be described with reference to first exemplary receiver 120; however, it should be understood that the disclosure is applicable to each of exemplary receivers 120, 120*a*, 130, 140, 150. First and second projections 123 and 125 are configured to allow for limited pivotal movement at the junctions between the first projection 123 and the base section 122; and the first projection 123 and second projection 125 respectively to allow side sections 124, 126 to move apart for rails 100, 110 to be resiliently inserted into the central cavity 121. Once rails 100, 110 are inserted into the central cavity 121, side sections 124, 126 move back into position to allow engagement with the rail 100, 110 such that the hook 127 abuts second flange 105, 115 thereby preventing movement of rails 100, 110 out of the central cavity 121. Accordingly, rails 110, 110 can be inserted into the central cavity 121 but cannot be easily removed without physical intervention to disengage and remove the impediments caused by hooks 127 and side sections 124, 126. The reference numerals of the various sections of the exemplary rails 100, 110 and receiver 120, 120*a* have largely been omitted from FIGS. 11(*b*) and 11(*c*) for clarity. As can be seen in FIG. 11(*c*), nubs 115*a* of exemplary rail 110 are configured to seat within the curved section of hook 127 thus providing additional resistance when in use. Any one of the exemplary rail receiver systems of the present disclosure can be adapted to include nubs 115*a* in the configuration of the rail component. In a further embodiment, fasteners such as, one or more screws can be placed through the exemplary rail 100, 110 and exemplary receiver 120, 120*a*, 130, 140, 150 when seated together in the concealed fastening system of the present disclosure thereby preventing lateral movement of the exemplary rail 100, 110 and exemplary receiver 120, 120*a*, 130, 140, 150. In such an embodiment, the fasteners are restricted to one location on the concealed fastening system of the present disclosure to allow for natural movement within the concealed fastening system to occur but prevent disengagement of the exemplary rail 100, 110 from the exemplary receiver 120, 120*a*, 130, 140, 150.

Third, fourth, and fifth exemplary receivers 130, 140, and 150 of the present disclosure are shown in FIGS. 11(*d*)-11(*i*). Third exemplary receiver 130 as shown in FIGS. 11(*d*) and 11(*e*) is substantially identical to that of first exemplary receiver 120. The third exemplary receiver 130 can have a base section 132 and side sections 134, 136 extending from the base section 132 such that a central cavity 131 is formed. The side sections 134, 136 can have a first projection 133, extending from the base section 132 and a second projection 135, extending from the first projection 133. In some embodiments, the second projection 135 can have a hook 137. In further embodiments, the base section 132 of the third exemplary receiver 130 has a plurality of hexagonal holes 138 provided to facilitate locating fasteners to secure exemplary rail 100, 110 to the secondary plate 64, 74, 84 of adaptor plates 60, 70, 80 or alternatively to the rear face 314 of a cladding panel 300 is shown. Similarly, fourth exemplary receiver 140 as shown in FIGS. 11(*f*) and 11(*g*) is substantially identical to that of first and third exemplary receiver 120 and 130. The fourth exemplary receiver 140 can have a base section 142 and side sections 144, 146 extending from the base section 142 such that a central cavity 141 is formed. The side sections 144, 146 can have a first projection 143, extending from the base section 142 and a second projection 145, extending from the first projection 143. In some embodiments, the second projection 145 can have a hook 147. Fourth exemplary receiver 140 comprises a plurality of oblong shaped holes 148 in base section 142. It should be understood that alternate configurations and frequencies of holes 138, 148, and 158 on base section 122, 132, 142, 152 can be selected as desired by the end user.

In each of first, second, third, and fourth exemplary receivers 120, 120*a*, 130, and 140 of the present disclosure, angle α ranges between approximately 92° and 156° +/−2°. In the exemplary receivers 120, 120*a*, 130, 140 angle α is more preferably between approximately 120° and 140°+/−2°. Angle β in the receiver 120, 120*a*, 130, 140 of the present disclosure ranges between approximately 93° and 157°+/−2° and more preferably is between approximately 123° and 143°+/−2°. In the exemplary receivers 120, 120*a*, 130, 140 angle β is approximately 131°+/−2°.

Referring now specifically to fifth exemplary receiver 150 as shown in FIGS. 11(*h*) and 11(*i*), there is shown an exemplary receiver 150 which is similar to that of first, second, third, and fourth exemplary receivers 120, 120*a*, 130, and 140. Fifth exemplary receiver 150 comprises extended side sections 154, 156 to allow for adjustment of the distance between a cladding panel 300 and a substrate 320 relative to the first, second, and third exemplary receivers 120, 130, and 140. In this way it is possible for the concealed fastening system of the present disclosure to achieve a lapped siding aesthetic as will be disclosed more fully below with reference to FIG. 19. Fifth exemplary receiver 150 comprises a base section 152 from which extended side sections 154, 156 project forming central cavity 151 in the internal area of the substantially 'U' shaped article. Extended side sections 154 and 166 each comprise an extension section 153*a* positioned between base section 152 and first projection 153. Each extension section 153*a* projects substantially orthogonally in the same direction from each side of base section 152 such that extension sections 153*a* are spaced apart and parallel to each other. Each of first projections 153 extend from extension sections 153*a* remote from base section 152 such that first projections 153 extend at an angle away from base section 152. The angle γ between each of first projections 153 and extension sections 153*a*, corresponds to angle α of first, second, and third exemplary receivers 120, 130, and 140 less the angle from which extension sections 153*a* extend from base section 152 which in the embodiment shown is substantially 90°. It should be understood that if first projections 153 were extended to base section 152, the angle between first projections 153 and base section 152 would be equivalent to angle α of first, second, and third exemplary receivers 120, 130, and 140. As before second projections 155 extend at an angle β from the first projection 153 remote from base section 152. The end of each second projection 155 remote from first projection 153 is also provided with a hook 157 in which the curved section is turned towards the central cavity 151. Base section 152 is further provided with hexagonal shaped holes 158 to facilitate locating fasteners to allow the rail 100, 110 to be secured to the secondary plates 64, 74, 84 of adaptor plates 60, 70, 80 or alternatively to the rear face 314 of a cladding panel 300 as shown in FIG. 17(*a*).

It should also be understood that the width and length of exemplary receivers 120, 120*a*, 130, 140, 150, 500 are commensurate with the width and length of exemplary rails 100, 110.

Although not shown, each of the exemplary rails 100, 110 and/or exemplary receivers 120, 120*a*, 130, 140, 150, 500 can be further provided with water management features to allow water to flow through the concealed fastening system of the present disclosure. Such features are known to a person skilled in the art and generally comprise a series of openings which allow water to pass through the exemplary rails 100, 110 and exemplary receivers 120, 120*a*, 130, 140, 150, 500 rather than sit on the top surface when in use, positioned between the substrate 320 and cladding element 300.

Figure 12A:
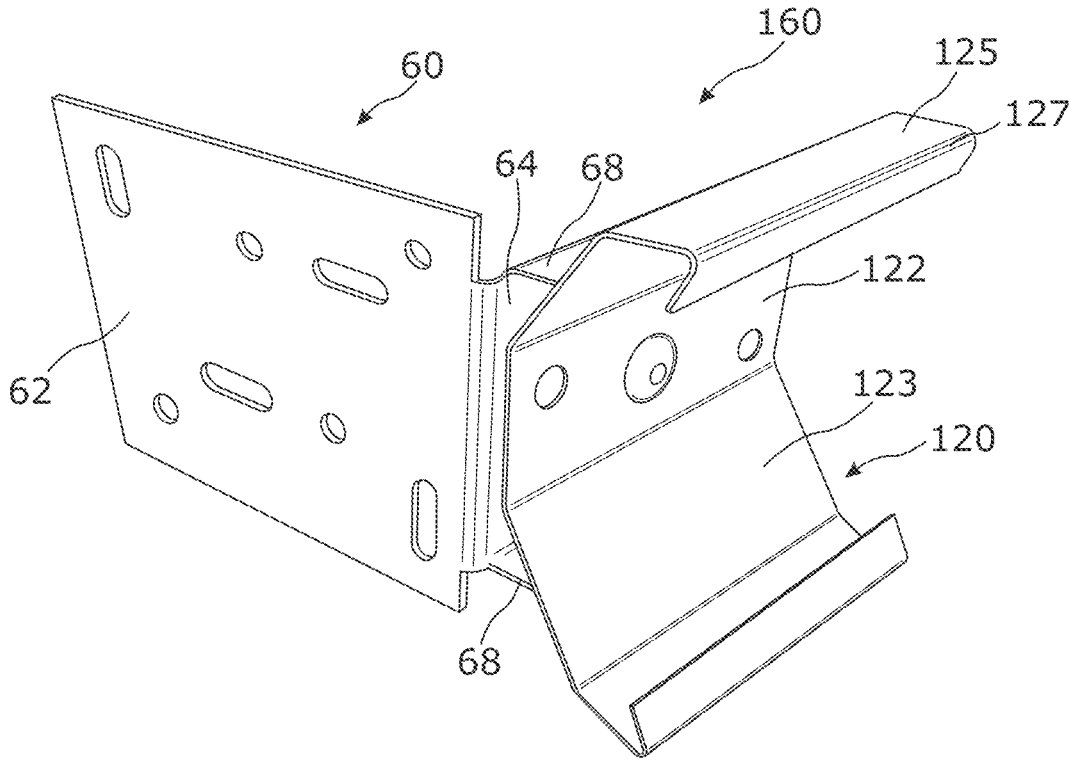
FIG. 12(*a*) is a perspective view of a first exemplary sub assembly of the present disclosure comprising the first exemplary adaptor plate of FIG. 6(*a*) together with the first exemplary receiver of FIG. 11(*a*)
Figure 12B:
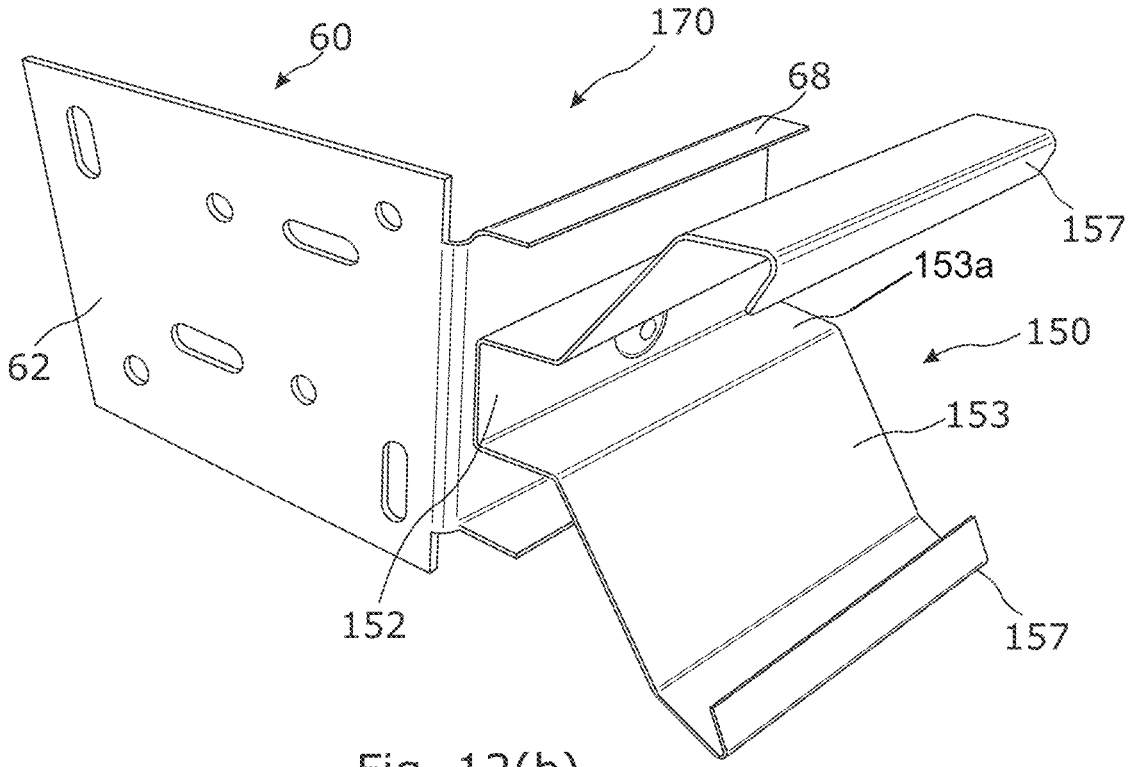

Referring now to FIGS. 12(*a*) and 12(*b*), there is shown perspective views of exemplary adaptor plate 60 on which receivers 120 and 150 have been secured to secondary plate 64 respectively. FIG. 12(*a*) shows adaptor plate 60 together with receiver 120 forming a central section 160 of a concealed fastening system of the present disclosure. FIG. 12(*b*) shows adaptor plate 60 together with receiver 150 forming an alternate embodiment of a central section 170 of a concealed fastening system of the present disclosure. Receiver 120, 150 receives rail 100, 110 as disclosed above. In an alternative configuration, exemplary rails 100, 110 can be secured to secondary plate 64 in similar way such that the configuration of a central section is reversed whereby rails 100, 110 are secured to the adaptor plate 60 and exemplary receivers 120, 130, 140, 150 are then inserted into exemplary rails 100, 110 as shown in FIGS. 13(*b*) and 13(*c*) and as described more fully below.

In one embodiment of the present disclosure, additional optional components such as, for example, internal and/or external corner trim fixing brackets 185 and 190 may be included as shown in FIGS. 15 and 16. These internal and/or external corner trim fixing brackets 185 and 190 can be secured to the base element 102, 112 of exemplary rails 100, 110 or base section 122, 122*a*, 132, 142, 152, 502 of exemplary receivers 120, 120*a*, 130, 140, 150, 500. As previously mentioned in the embodiment of the present disclosure comprising an adaptor plate 60, 70, 80 additional optional components such as for example internal and/or external corner trim fixing brackets 185 and 190 are also secured to the secondary plate, 64, 74, 84 of exemplary adaptor plates 60, 70, 80 via elongate opening 65.

Referring now to FIGS. 13(*a*), 13(*b*), and 13(*c*), there is shown three further alternate exemplary embodiments of the concealed fastening system 200, 210, 220 of the present disclosure. FIG. 13(*a*) shows a third exemplary embodiment of the concealed fastening system 200 of the present disclosure comprising a first exemplary embodiment bracket 10 to which a first exemplary embodiment adaptor plate 60 has been secured substantially as outlined above with respect to exemplary bracket 30 and exemplary adaptor plate 80 (not visible) as shown in FIG. 9. First exemplary receiver 120 has been secured to secondary plate 64 (not visible) of adaptor plate 60 as outlined above with respect to FIG. 12(*a*) and exemplary rail 100 has been inserted into first exemplary receiver 120 as outlined above with respect to FIG. 11(*b*). FIG. 13(*b*) shows a fourth exemplary embodiment of the concealed fastening system 210 of the present disclosure in which the locations of the exemplary rail 100 and first exemplary receiver 120 have been reversed, that is, exemplary rail 100 has been secured to secondary plate 64 (not visible) of adaptor plate 60 and then inserted into first exemplary receiver 120. FIG. 13(*c*) shows a fifth exemplary embodiment of the concealed fastening system 220 comprising a first exemplary embodiment bracket 10 and first exemplary embodiment adaptor plate 60 as before. Exemplary rail 100 has been secured to secondary plate 64 (not visible) of adaptor plate 60 and then inserted into fourth exemplary receiver 150.

Figure 14:
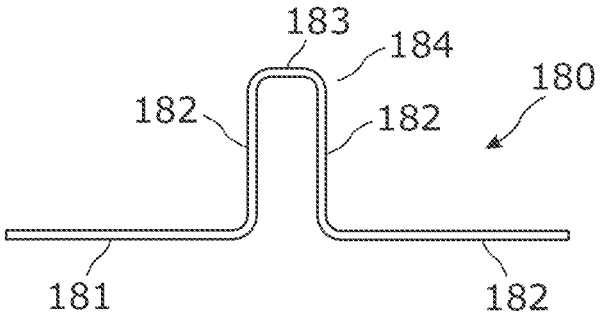
FIG. 14 is an end view of an exemplary joint profile of the present disclosure.

Turning briefly to FIGS. 14, 15, and 16, there is shown an exemplary joint profile 180, an exemplary external corner profile 185 and an exemplary internal corner profile 190 respectively. Each of these profiles 180, 185, 190 can be secured to the secured to the base element 102, 112 of exemplary rails 100, 110 or base section 122, 122*a*, 132, 142, 152, 502 of exemplary receivers 120, 120*a*, 130, 140, 150, 500 and also to the secondary plate 64, 74, 84 of adaptor plates 60, 70, 80 via elongate opening 65 (FIG. 6(*b*)) if adaptor plates 60, 70, 80 are present. These are exemplary profiles 180, 185, 190 for use when installing cladding elements 300 on a building using the concealed fastening system of the present disclosure. It is common practice to use joint profiles such as joint profile 180 to provide a visible aesthetic joint between adjacent cladding elements 300. Similarly, it is also often desired to provide trim elements at the corners of buildings such as for example internal and external corner profiles 190 and 185 respectively to create the appropriate finish at a corner when installing cladding on a building structure.

Joint profile 180, comprises fastening strips 181 on either side of protrusion 184 comprising side flanks 182 and base flank 183. In use, joint profile 180 is secured to the secondary plate 64, 74, 84 of one or more adaptor plates 60, 70, 80 such that base flank 183 can be positioned between two adjacent cladding elements 300 (FIG. 17(*a*)) thereby forming the visible portion of a joint between the two adjacent cladding elements 300. Similarly, in the event it is desired to provide either internal or external corner profiles 190, 185 between adjacent cladding elements 300 on a building façade, internal corner profile 190 is secured to the secondary plate 64, 74, 84 of adaptor plates 60, 70, 80 via side flanks 191, 194 such that internal flanks 192, 193 form an internal corner 195 between two cladding elements 300. In a similar manner, external corner profile 185 is secured to the secondary plate 64, 74, 84 of adaptor plates 60, 70, 80 via side flanks 186 such that the box section 189 formed by internal flanks 187 forms an external corner between two cladding elements 300. Internal flanks 187 do not form a closed box section 189. A gap 188 is provided to allow some flexibility during the installation process and/or after installation.

Turning now to FIGS. 17(*a*)-17(*e*), there is shown an exemplary sequence of steps for one method of installing a building panel 300 using an exemplary concealed fastening system of the present disclosure; FIG. 17(*a*) is a perspective view of the building panel 300 comprising a front face 312, a rear face 314 spaced apart from the front face 312 and a side face 316 intermediate to and contiguous to each of the front face 312 and rear face 314. Building panel 300 is configured for installation on a building substructure such that major external surfaces or front face 312 of adjacent building panels 300 are positioned together in sequence to create an external façade on the building. In the embodiment shown in the present disclosure, building panel 300 is a fiber cement cladding panel manufactured using the Hatschek process. Alternative suitable fiber cement manufacturing processes, such as, for example, Flow-on or Fourdrinier or any other suitable manufacturing process known to the skilled person could also be used. It is also understood that building panel 300 can be made from any material suited to the intended application for example, timber, plasterboard, a panel which has alternate materials such as for example brick slips forming an external face of the panel or the like. Manufacturer's recommendations should be followed regarding Suitability. A plurality of exemplary rails 100 are secured to the rear face 314 of cladding panel 300. In one embodiment of the present disclosure exemplary rail 100 is installed using mechanical means or a combination of mechanical and chemical means. The number and position of exemplary rails 100 secured to the rear face 314 of each building panel 300 is determined by the position of the corresponding exemplary receiver 120 on the substrate 320 which will be determined in turn by the size and weight of building panels 300 to be secured to the substrate 320 and also superimposed variable loading created by environmental conditions, for example wind loads which will be known and/or available to the person skilled in the art. It is of course understood that in further embodiments of the present disclosure, one or more of exemplary rail 110, 110 or alternatively in a reverse configuration one or more of exemplary receivers 120, 120*a*, 130, 140, 150 could be installed on the rear face 314 of cladding panel 300. In such a reverse configuration exemplary rails 100, 110 are then installed directly or additionally with exemplary brackets 10, 20, 30, 40, 50 and adaptor plates 60, 70, 80 onto substrate 320.

FIG. 17(*b*) is a partial perspective view of a building substrate 320 on which a number of horizontal and vertical framing members 324 and 326 respectively have been positioned on the external face 322 of building substrate 320. The position of the horizontal framing members 324 is such that the horizontal framing members 324 are aligned with the position of the exemplary rails 100 on the rear face 314 of building panel 300 as illustrated in FIG. 17(*d*). It should be understood that the horizontal and vertical framing members 324 and 326 respectively are optional. For example, horizontal and vertical framing members 324 and 326 respectively are often used to further assist when trying to overcome the instance where an external face 322 of a building substrate 320 has an uneven surface. Exemplary brackets 10 have been positioned on horizontal framing members 324. The frequency and position of exemplary brackets 10 on horizontal framing members 324 is determined by a person skilled in the art and is determined by factors including the size and weight of building panels 300 to be secured to the substrate 320 and also superimposed variable loading created by environmental conditions, for example wind loads. Any one of the exemplary brackets 10, 20, 30, 40, 50 of the present disclosure can be attached to the horizontal and vertical framing members 324 and 326 or directly to the building substrate 320 as desired by the installer.

All preparatory works deemed necessary by a person skilled in the art for example, levelling of building subassemblies should be completed before installing any building panels 300 for example, a floor top and base subassembly should be lined and levelled to the corners as determined necessary by the person skilled in the art. It is preferable that the preparatory works completed result in the substrate being weather protected before installation begins. Although not shown, building paper or house wrap, may optionally also be installed on the external face 322 of the building substrate 320, between the external face 322 of the building substrate 320 and the horizontal and vertical framing members 324 and 326 (or exemplary brackets 10, 20, 30, 40, 50 of the present disclosure in the event that horizontal and vertical framing members 324 and 326 are not present). Building wrap is intended to provide additional protection against liquid water, such as from ingress of wind driven rain, through the external façade until it contacts a building frame where it may cause durability issues if it is resident there over extended periods of time. An example of such a product is HardieWrap™, available from James Hardie. HardieWrap™ is a breathable non-woven polyolefin sheet, which prevents transmission of liquid water, but allows for transmission of water vapor, thereby allowing any water trapped against the frame to dry out over time. The building paper or building wrap is installed by nailing at predetermined intervals to the external face 322 of the building substrate 320, as per manufacturer's installation instructions. In alternative embodiments sheathing board as known to a person skilled in the art could be used to provide weather protection to the substrate 320.

FIG. 17(*c*) is a partial perspective side view 330 of the building substrate 320 of FIG. 17(*b*) which shows exemplary adaptor plate 60 and exemplary receiver 120 now secured to each of exemplary brackets 10 thereby forming a central section of a concealed fastening system of the present disclosure. As disclosed above, the main plate 62 (not visible) of exemplary adaptor plate 60 is placed on the first plate 14 (not visible) of exemplary bracket 10. Although not shown, it should be understood that the main plate 62 (not visible) of exemplary adaptor plate 60 can also be placed and seated under a clip mechanism 15, 25, 35, 45, 55, 57 together with additional fasteners as desired to secure exemplary adaptor plate 60 to exemplary bracket 10. Exemplary receiver 120 has been secured to the secondary plate 64 (not visible) of adaptor plate 60 by fixings extending through holes in the base section of receiver 120.

FIG. 17(*d*) is a partial perspective side view of the building substrate 320 of FIG. 17(*c*) in which exemplary rail 100 positioned on the rear face 314 of building panels 300 has been placed in exemplary receiver 120. To achieve this, the building panel 300 is simply brought into alignment with the building substrate 320 and pushed into position so that the exemplary rail 100 is resiliently mounted within exemplary receiver 120 as disclosed above. In this way a number of building panels 300 can be easily mounted on a building substrate 320 using the concealed fastening system of the present disclosure by simply pushing the building panels 300 into position in accordance with the present disclosure. Horizontal and vertical framing members 324 and 326 respectively are also seen in FIG. 17(*d*) positioned such that the horizontal framing members 324 are aligned with the position of the exemplary rails 100 on the rear face 314 of building panel 300. FIG. 17(*e*) is a partial perspective front view of FIG. 17(*d*) showing the front faces 312 of multiple building panels 300 installed using the concealed fastening system of the present disclosure.

FIGS. 18(*a*)-18(*d*) show an alternate embodiment of an exemplary receiver 500 in position on an adaptor plate (not visible) and bracket 10 mounted to horizontal member 324 on building substrate 320. Exemplary receiver 500 has been designed to accommodate a support member 510. Support member 510 comprises a square faced beam structure comprising at least a front face 514 and side face 512. Support member 510 is used to provide additional support at a junction between adjacent building panels 300 (not visible). Additional support member 510 can also be used to provide an aesthetic finish as disclosed further below. Exemplary receiver 500 is similar to that of first, second, third, and fourth exemplary receivers 120, 120*a*, 130, and 140 comprising a base section 502 from which a first projection 503 and a second projection 505, wherein first projections 503 extend from each side of base section 502 and second projections 505 extend from the first projection 503 remote from base section 502. The end of each second projection 505 remote from first projection 503 can be provided with a hook 507. First projection 503, second projection 505, and hook 507 can have a central cut-away portion 503*a*, 507*c* (not visible) forming a seating area for support member 510 as shown in FIGS. 18(*b*) and 18(*c*). Cut-away portion 507*c* forms a first and second region 507*a* and 507*b* within second projection 505 and hook 507 which enables an installer to insert an exemplary rail 100 of the present disclosure into exemplary receiver 500 such that the exemplary rail 100 and panel 300 can abut each side face 512 and front face 514 as shown in FIG. 18(*c*), therein exemplary rail 100 positioned on the rear face 314 of panel 300 has been inserted into second region 507*b*. With reference to FIG. 18(*d*), there is shown a joint aesthetic which is created using the exemplary receiver 500 (shown in dotted form to the rear of two adjacent panels). Rear face 314 (not visible) of panel 300 is seated against the front face 514 of support member 510 such that side face 316 of panel 300 is slightly off center and perpendicular to front face 514 of support member 510. In practice when a second panel 300 is placed on the building substrate 320 (not visible) using first region 507*a* of the hook 507. The second panel 300 is also positioned slightly off center on the support member 510 such that a gap is formed between the first and second panel 300 forming a joint aesthetic wherein the front face 514 of support member 510 forms the base of the joint aesthetic and the side faces 316 of the first and second panels 300 form the sides of the joint aesthetic as shown in FIG. 18(*d*). One or more exemplary receivers 500 can be used to support the panels 300 as needed along the length of the joint aesthetic as determined by the installer.

Figure 19:
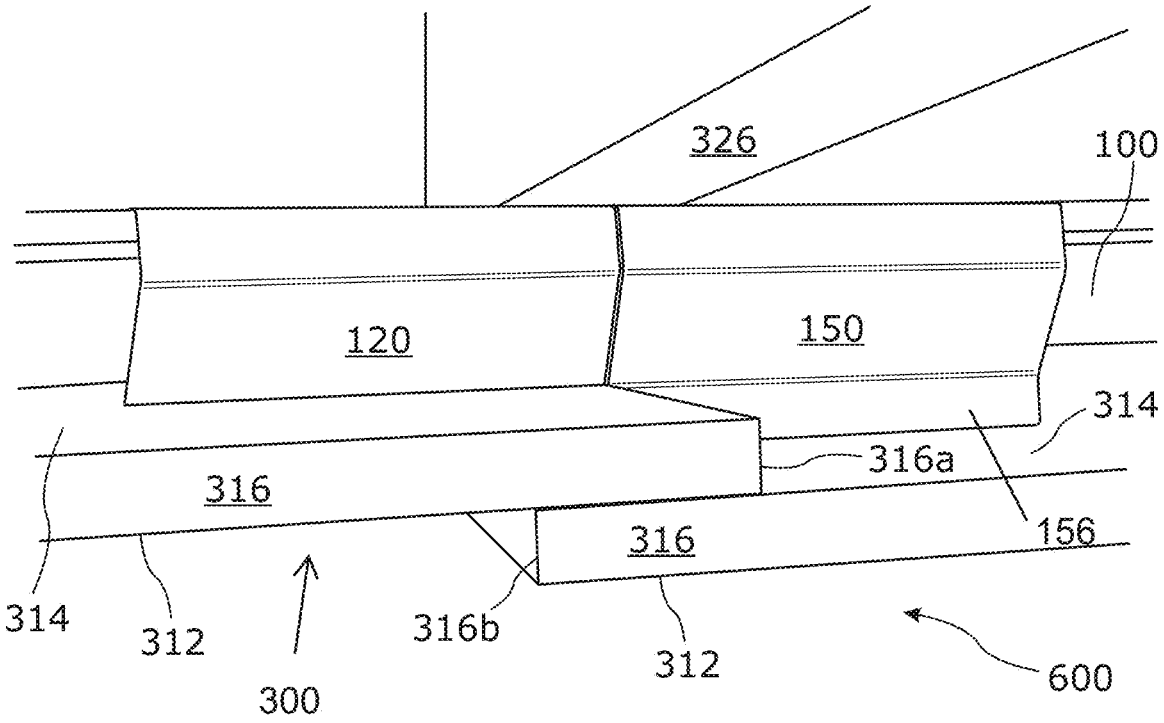
FIG. 19 is a top perspective sectional view of a sixth exemplary concealed fastening system of the present disclosure.

Turning now to FIG. 19, there is shown a further configuration 600 of two adjacent building panels 300 installed on a substrate 320 (not visible) using the concealed fastening system of the present disclosure such that the adjacent building panels 300 are installed in an overlapped configuration 600. Exemplary receivers 120 and 150 have both been secured to the rear face 314 of a panel 300 such that exemplary receiver 120 is located at the edge of rear face 314 adjacent first side face 316*a* and exemplary receiver 150 is secured slightly away from the edge of rear face 314 such that there is a space between exemplary receiver 150 and second side face 316*b*. In the exemplary embodiment shown receiver 150 is secured approximately 50 mm+/−0.5 mm away from the edge of rear face 314. It should be understood that it is also possible for exemplary receiver 150 to be located at the edge of rear face 314 adjacent second side face 316*b*. When a first panel 300 is installed on a building substrate 320 (not visible) using the concealed fastening system of the present disclosure, the extended side sections 156 of exemplary receiver 150 causes one side of panel 300 to project further than the opposing side of panel 300 to which exemplary receiver 120 is secured. The distance that exemplary receiver 150 projects further is equivalent to the approximate thickness of the building panel 300 such that the edge of one building panel 300 to which exemplary receiver 120 is secured can seat behind the edge of a second building panel 300 to which exemplary receiver 150 is secured forming an overlap is touching in the form of a shiplap joint as shown. In this configuration, exemplary receivers 120, 150 on first and second building panels 300 are collocated on exemplary rail 100 and first side face 316*a* abuts exemplary receiver 150. In an alternate embodiment, the distance that exemplary receiver 150 projects is greater than the approximate thickness of the building panel 300 such that the edge of one building panel 300 to which exemplary receiver 150 is secured is spaced apart from the edge of a second building panel 300 to which exemplary receiver 120 is secured forming an open-space lap joint.

Each of the components of the concealed fastening system of the present disclosure may be formed from a range of materials including, but not limited to, metals such as steel or aluminum, or polymeric materials such as fiber reinforced polymer composites. It is preferable when using metals such as steel that the steel grades have mechanical properties which are equivalent to or exceed the requirements specified in EN 10346 2015 as associated with structural steel grades DX51, S220 and S450. In the instance where the components of the concealed fastening system are formed from metals such as steel or aluminum, the materials are formed into the desired configuration using known forming techniques such as but not limited to, for example, punching, rolling, pressing, forging or extrusion. It should also be understood that the dimensions of the exemplary rails may change in accordance with the strength of the material used to form the component part for example if higher grade steel is used, greater loads can be carried by the concealed fastening system of the present disclosure. Consequently, either the size and/or frequency and/or positioning of the components of the concealed fastening system on a substrate/cladding element can be adjusted accordingly as determined by a person skilled in the art.

It will of course be understood that the invention is not limited to the specific details described herein, which are given by way of example only, and that various modifications and alterations are possible within the scope of the disclosure as defined in the appended claims.

Certain features that are described in this disclosure in the context of separate implementations can also be implemented in combination in a single implementation. Conversely, various features that are described in the context of a single implementation can also be implemented in multiple implementations separately or in any suitable sub-combination. Moreover, although features may be described above as acting in certain combinations, one or more features from a claimed combination can, in some cases, be excised from the combination, and the combination may be claimed as any sub-combination or variation of any sub-combination.

Moreover, while methods may be depicted in the drawings or described in the specification in a particular order, such methods need not be performed in the particular order shown or in sequential order, and that all methods need not be performed, to achieve desirable results. Other methods that are not depicted or described can be incorporated in the example methods and processes. For example, one or more additional methods can be performed before, after, simultaneously, or between any of the described methods. Further, the methods may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Conditional language, such as 'can', 'could', 'might', or 'may', unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase 'at least one of X, Y, and Z' unless specifically stated otherwise, is otherwise understood with the context as used in general to convey that an item, term, etc. may be either X, Y or Z. Thus, such conjunctive language is not generally intended to imply that certain embodiments require the presence of at least one of X, at least one of Y, and at least one of Z.

Language of degree used herein, such as the terms 'approximately', 'about', 'generally' and 'substantially' as used herein represent a value, amount, or characteristic close to the stated value, amount or characteristic that still performs a desired function or achieves a desired result. For example, the terms 'approximately', 'about', 'generally' and 'substantially' may refer to an amount that is within less than or equal to 10% of, within less than or equal to 5% of, within less than or equal to 1% of, within less than or equal to 0.1% of, and within less than or equal to 0.01% of the stated amount.

Although making and using various embodiments are discussed in detail below, it should be appreciated that the description provides many inventive concepts that may be embodied in a wide variety of contexts. The specific aspects and embodiments discussed herein are merely illustrative of ways to make and use the systems and methods disclosed herein and do not limit the scope of the disclosure. The systems and methods described herein may be used in conjunction with decorated fiber cement building panels and are described herein with reference to this application. However, it will be appreciated that the disclosure is not limited to this particular field of use.

Some embodiments have been described in connection with the accompanying drawings. The figures are not drawn to scale, and some features have been exaggerated for the purposes of clarity and conciseness. Dimensions and proportions other than what are shown are contemplated and are within the scope of the disclosed inventions. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

While a number of embodiments and variations thereof have been described in detail, other modifications and methods of using the same will be apparent to those of skill in the art. Accordingly, it should be understood that various applications, modifications, materials, and substitutions can be made of equivalents without departing from the unique and inventive disclosure herein or the scope of the claims.

What is claimed is:

1. A concealed fastening system suitable for securing a cladding element to a substrate comprising:

a receiver comprising:

a base section configured to mount to a cladding element or a substrate;

a plurality of side sections extending from the base section to form a cavity between the base section and the plurality of side sections, each side section comprising:

a first projection extending from the base section at a first angle $\alpha$; and a second projection spaced from the base section and extending from the first projection at a second angle β, the second projection comprising a protrusion spaced from the first projection; and a rail comprising:

a base element configured to mount to a cladding element or a substrate; and a plurality of side arms extending from the base element, each side arm comprising:

a first flange extending orthogonally from the base element;

a second flange spaced from the base element and extending orthogonally remote from the first flange in a direction away from the base element;

a third flange spaced from the first flange and extending orthogonally from the second flange; and a fourth flange spaced from the second flange and extending at a third angle δ from the third flange such that the fourth flanges of each side arm extend towards each other, wherein the rail seats at least partially within the cavity of the receiver such that each side arm of the rail engages at least one of the protrusions of the side sections of the receiver, wherein a width of the rail is equivalent to a sum of the widths of the base element and each of the second flanges.

2. A concealed fastening system suitable for securing a cladding element to a substrate comprising:

a receiver comprising:

a base section configured to mount to a cladding element or a substrate;

a plurality of side sections extending from the base section to form a cavity between the base section and the plurality of side sections, each side section comprising:

a first projection extending from the base section at a first angle α; and a second projection spaced from the base section and extending from the first projection at a second angle β, the second projection comprising a protrusion spaced from the first projection;

a rail comprising:

a base element configured to mount to a cladding element or a substrate; and a plurality of side arms extending from the base element, each side arm comprising:

a first flange extending orthogonally from the base element;

a second flange spaced from the base element and extending orthogonally from the first flange;

a third flange spaced from the first flange and extending orthogonally from the second flange;

a fourth flange spaced from the second flange and extending at a third angle δ from the third flange such that the fourth flanges of each side arm extend towards each other, wherein the rail seats at least partially within the cavity of the receiver such that each side arm of the rail engages at least one of the protrusions of the side sections of the receiver;

a bracket comprising:

a first plate; and a second plate extending orthogonally from the first plate and configured to attach to the substrate; and an adaptor plate comprising:

a main plate configured to attach to the first plate of the bracket; and a secondary plate extending orthogonally from the main plate and configured to attach to the receiver or the rail.

3. The concealed fastening system of claim 2, wherein the third angle δ is between 92° and 160°.

4. The concealed fastening system of claim 3, wherein the third angle δ is approximately 132°+/−2°.

5. The concealed fastening system of claims 2, wherein the first angle α is between 90° and 158°.

6. The concealed fastening system of claim 5, wherein the first angle α is approximately 125°+/−2°.

7. The concealed fastening system of claim 2, wherein the second angle β is between 91° and 159°.

8. The concealed fastening system of claim 7, wherein the second angle β is approximately 131°+/−2°.

9. The concealed fastening system of claim 1, wherein each side arm of the rail further comprises a nub disposed at a junction between the second flange and the third flange.

10. The concealed fastening system of claim 9, wherein each side arm of the rail further comprises a groove at the junction between the second flange and the third flange.

11. The concealed fastening system of claim 1, wherein each side section of the receiver further comprises an extended side section disposed between the base section and the first projection.

12. The concealed fastening system of claim 1, wherein each side section of the receiver further comprises a medial cut-away portion extending through at least a portion of the second projection and the protrusion.

13. The concealed fastening system of claim 1, further comprising:

a bracket comprising:

a first plate; and a second plate extending orthogonally from the first plate and configured to attach to the substrate; and an adaptor plate comprising:

a main plate configured to attach to the first plate of the bracket; and a secondary plate extending orthogonally from the main plate and configured to attach to the receiver or the rail.

14. The concealed fastening system of claim 2, wherein the bracket further comprises a clip mechanism, wherein the clip mechanism comprises a first end connected to the first plate and second end remote from the first end.

15. The concealed fastening system of claim 14, wherein the second end is spaced apart from the first plate such that a gap is formed between the clip mechanism and the first plate.

16. The concealed fastening system of claim 2, wherein the bracket further comprises side walls extending orthogonally from at least one of the first plate and the second plate such that the side walls are spaced apart from each other by a width of the bracket.

17. The concealed fastening system of claim 2, wherein the bracket further comprises a detent disposed at a junction between the first plate and the second plate.

18. The concealed fastening system of claim 1, wherein each protrusion comprises a hook.

19. A concealed fastening system suitable for securing a cladding element to a substrate comprising:

a receiver comprising:

a base section configured to mount to a cladding element or a substrate;

a plurality of side sections extending from the base section to form a cavity between the base section and the plurality of side sections, each side section comprising:

a first projection extending from the base section at a first angle a; and a second projection spaced from the base section and extending from the first projection at a second angle β, the second projection comprising a protrusion spaced from the first projection; and a rail comprising:

a base element configured to mount to a cladding element or a substrate; and a plurality of side arms extending from the base element, each side arm comprising:

a first flange extending orthogonally from the base element;

a second flange spaced from the base element and extending orthogonally from the first flange;

a third flange spaced from the first flange and extending orthogonally from the second flange;

a fourth flange spaced from the second flange and extending at a third angle δ from the third flange such that the fourth flanges of each side arm extend towards each other;

a nub disposed at a junction between the second flange and the third flange; and a groove at the junction between the second flange and the third flange;

wherein the rail seats at least partially within the cavity of the receiver such that each side arm of the rail engages at least one of the protrusions of the side sections of the receiver.

20. The concealed fastening system of claim 2, wherein the third angle δ of the rail is equal to or greater than the second angle β of the receiver.

* * * * *